US011693335B2

(12) United States Patent
Oka et al.

(10) Patent No.: US 11,693,335 B2
(45) Date of Patent: Jul. 4, 2023

(54) DEVELOPMENT CARTRIDGE

(71) Applicant: CANON KABUSHIKI KAISHA, Tokyo (JP)

(72) Inventors: Takuya Oka, Kanagawa (JP); Issei Imamura, Shizuoka (JP); Ryohei Tsutsumi, Shizuoka (JP); Keitaro Nakata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/685,198

(22) Filed: Mar. 2, 2022

(65) Prior Publication Data

US 2022/0187739 A1 Jun. 16, 2022

Related U.S. Application Data

(63) Continuation of application No. 17/327,525, filed on May 21, 2021, now Pat. No. 11,300,900.

(30) Foreign Application Priority Data

May 29, 2020 (JP) ..... 2020-095018

(51) Int. Cl.
*G03G 15/08* (2006.01)

(52) U.S. Cl.
CPC ..... *G03G 15/0889* (2013.01)

(58) Field of Classification Search
CPC ..... G03G 15/0887; G03G 15/0889; G03G 15/0891; G03G 15/0893; G03G 21/1814
See application file for complete search history.

(56) References Cited

U.S. PATENT DOCUMENTS

| | | | | |
|---|---|---|---|---|
| 9,366,992 | B2 * | 6/2016 | Hashimoto | G03G 15/0867 |
| 10,527,971 | B2 * | 1/2020 | Nakamura | G03G 21/1814 |
| 2006/0222414 | A1 * | 10/2006 | Yamamura | G03G 15/0822 399/263 |
| 2008/0247784 | A1 * | 10/2008 | Kakuta | G03G 15/0877 399/262 |
| 2012/0033999 | A1 * | 2/2012 | Ichikawa | G03G 15/0879 399/262 |

* cited by examiner

*Primary Examiner* — Hoang X Ngo
(74) *Attorney, Agent, or Firm* — Canon U.S.A., Inc. I.P. Division

(57) ABSTRACT

A cartridge mountable in an apparatus main body of an image forming apparatus, the cartridge includes a development roller, a frame member including a development chamber, a developer containing chamber, and a first opening portion, the developer containing chamber including an inner wall and a second opening portion, a stirring member including a stirring shaft and a sheet, and a conveyance member driven in such a manner that the developer is replenished into the developer containing chamber through the second opening portion, wherein the sheet is rotated in contact with the inner wall in such a manner that, after the sheet is elastically deformed by contact with a portion of the inner wall, at least a part of the elastic deformation is restored, and wherein the conveyance member is being driven at a timing when the sheet passes through the front side.

8 Claims, 16 Drawing Sheets

DEVELOPMENT CARTRIDGE

CROSS-REFERENCE TO RELATED APPLICATIONS

The present application is a continuation of U.S. patent application Ser. No. 17/327525, filed on May 21, 2021, which claims priority from Japanese Patent Application No. 2020-095018, filed May 29, 2020, which are hereby incorporated by reference herein in their entireties.

BACKGROUND OF THE INVENTION

Field of the Invention

The present invention relates to a development cartridge used in an electrophotographic image forming apparatus, such as a copying machine, a printer, and a facsimile machine.

Description of the Related Art

As an electrophotographic image forming apparatus, there is known a configuration in which a development cartridge including a development roller is arranged below an intermediate transfer unit (Japanese Patent Application Laid-Open No. 2011-253203). A development chamber having the development roller of such a development cartridge disposed therein is provided above a toner containing chamber (a developer containing chamber) containing toner (a developer). This leads to the employment of a configuration that supplies the toner to the development chamber by rotating a stirring member including a sheet to cause the toner contained in the toner containing chamber to fly upward.

SUMMARY OF THE INVENTION

According to an aspect of the present invention, a cartridge detachably mountable in an apparatus main body of an image forming apparatus, the cartridge includes a development roller bearing a developer thereon and rotatably configured, a frame member including a development chamber in which the development roller is provided, a developer containing chamber containing the developer and located below the development chamber in a state where the cartridge is mounted in the apparatus main body, and a first opening portion establishing communication between the development chamber and the developer containing chamber, the developer containing chamber including an inner wall and a second opening portion for receiving the developer replenished from outside the cartridge into the developer containing chamber, a stirring member provided rotatably in the developer containing chamber and configured to stir the developer contained in the developer containing chamber, the stirring member including a stirring shaft extending in a direction of a rotational axis of the development roller and a sheet attached to the stirring shaft so as to rotate together with the stirring shaft, and a conveyance member configured to be able to be driven in such a manner that the developer is replenished into the developer containing chamber via the second opening portion, wherein the sheet of the stirring member is configured to rotate in contact with the inner wall of the developer containing chamber in such a manner that, after the sheet is elastically deformed by contact with a portion of the inner wall, at least a part of the elastic deformation is restored, thereby projecting the developer on the sheet toward the first opening portion, wherein the second opening portion of the developer containing chamber is disposed at a position in such a manner that the sheet passes through a front side thereof when the stirring member is rotating, and wherein the conveyance member is configured to be kept driven at a timing when the sheet passes through the front side of the second opening portion while the stirring member is rotating.

Further features of the present invention will become apparent from the following description of embodiments with reference to the attached drawings.

DESCRIPTION OF THE EMBODIMENTS

In the following description, an image forming apparatus and a process cartridge according to an embodiment of the present invention will be described with reference to the drawings.

<Overall Configuration of Image Forming Apparatus>

Figure 1:
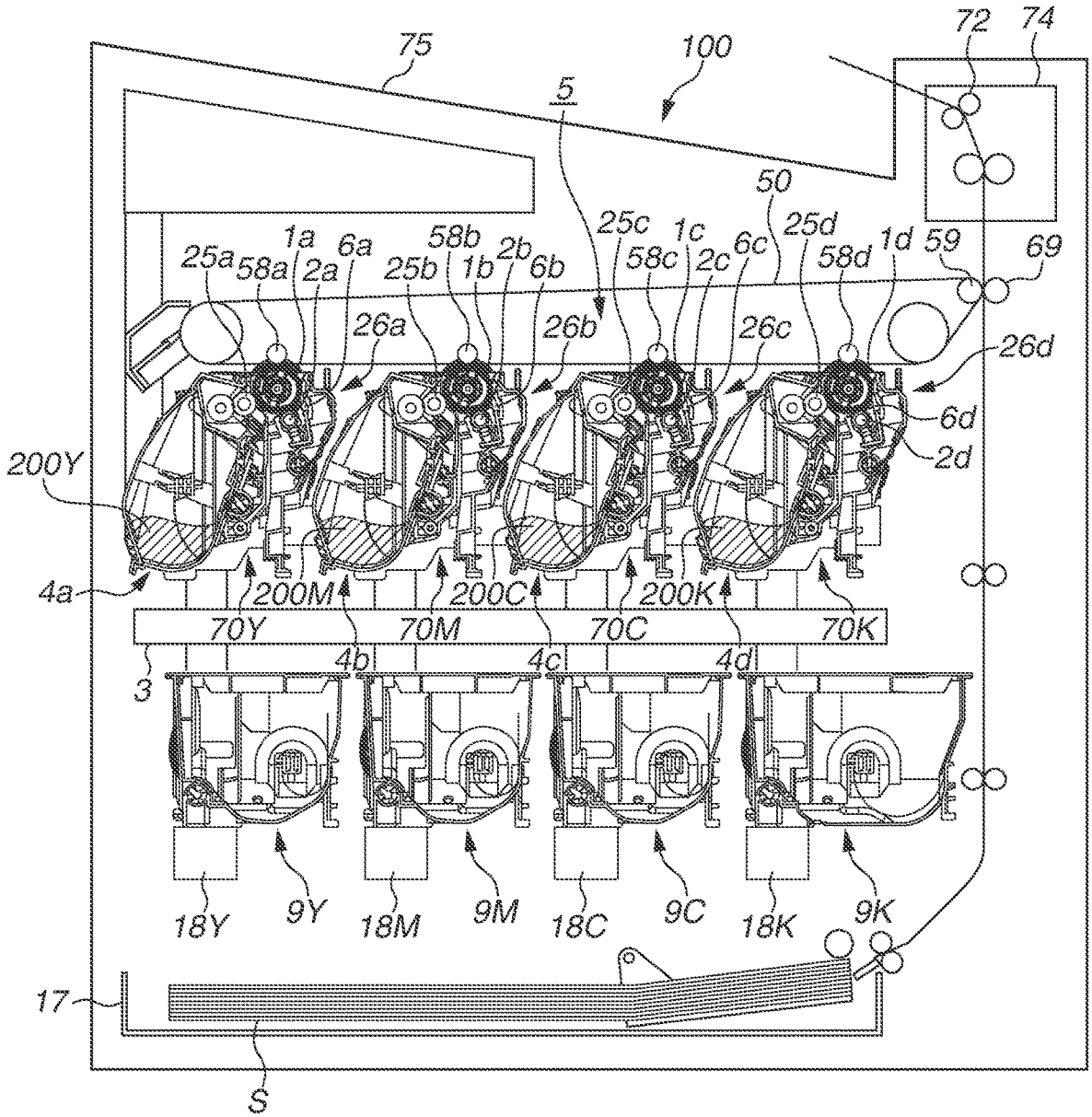
FIG. 1 is a diagram illustrating a configuration of an electrophotographic image forming apparatus in which a process cartridge according to an embodiment of the present invention is mounted.

First, the overall configuration of an electrophotographic image forming apparatus 100 will be described with reference to FIG. 1. As illustrated in FIG. 1, detachably mountable four process cartridges 70 (70Y, 70M, 70C, and 70K) are mounted using mounting members (not illustrated). Further, an upstream side and a downstream side in a direction in which the process cartridge 70 is mounted in the image forming apparatus 100 are defined to be a front-side surface side and a rear-side surface side, respectively.

Each of the process cartridges 70 includes an electrographic photosensitive drum (hereinafter referred to as a photosensitive drum) 1 (1*a*, 1*b*, 1*c*, 1*d*) and a development roller 25 (25*a*, 25*b*, 25*c*, 25*d*). Each of the process cartridges 70 further includes a process unit such as a charging roller 2 (2*a*, 2*b*, 2*c*, 2*d*) and a cleaning member 6 (6*a*, 6*b*, 6*c*, 6*d*). The charging roller 2 functions to evenly charge the surface of the photosensitive drum 1, and the development roller 25 functions to develop a latent image formed on the photosensitive drum 1 with toner to visualize it. Then, the cleaning member 6 functions to remove toner remaining on the photosensitive drum 1 after the toner image formed on the photosensitive drum 1 is transferred onto a recording medium.

Further, a scanner unit 3, which is used to selectively expose the photosensitive drum 1 based on image information to form the latent image on the photosensitive drum 1, is provided below the process cartridges 70.

A cassette 17, which contains a recording medium S, is mounted at a lower portion of the apparatus main body 100A. Then, a recording medium conveyance unit is provided in such a manner that the recording medium S passes through a secondary transfer roller 69 and a fixing unit 74, and then is conveyed to above the apparatus main body 100A. Further, an intermediate transfer unit 5, which serves as an intermediate transfer unit for transferring the toner image formed on each of the photosensitive drums 1 (1*a*, 1*b*, 1*c*, and 1*d*), is provided above the process cartridges 70 (70Y, 70M, 70C, and 70K). The intermediate transfer unit 5 includes primary transfer rollers 58 (58*a*, 58*b*, 58*c*, and 58*d*) at positions facing the photosensitive drums 1 for the respective colors, and a facing roller 59 at a position facing the secondary transfer roller 69, and a transfer belt 50 is hung across the primary transfer rollers 58 and the facing roller 59. The transfer belt 50 circulates and moves so as to face and contact all of the photosensitive drums 1, and the toner images are primarily transferred from the photosensitive drums 1 onto the transfer belt 50 by application of voltages to the primary transfer rollers 58 (58*a*, 58*b*, 58*c*, and 58*d*). Then, the toner on the transfer belt 50 is transferred onto the recording medium S by application of a voltage to the facing roller 59 disposed inside the transfer belt 50 and the secondary transfer roller 69.

At the time of image formation, each of the photosensitive drums 1 is rotated, and the photosensitive drum 1 evenly charged by the charging roller 2 is selectively exposed by the scanner unit 3. By this operation, the electrostatic latent image is formed on the photosensitive drum 1. This latent image is developed by the development roller 25. By this development, a toner image of each color is formed on each of the photosensitive drums 1. In synchronization with this image formation, a pair of registration rollers 55 conveys the recording medium S to a secondary transfer position at which the facing roller 59 and the secondary transfer roller 69 are in abutment with each other via the transfer belt 50 interposed therebetween. Then, the toner image of each color on the transfer belt 50 is secondarily transferred onto the recording medium S by application of a transfer bias voltage to the secondary transfer roller 69. By this operation, a color image is formed on the recording medium S. The recording medium S with the color image formed thereon is heated and pressed by the fixing unit 74, by which the toner image is fixed thereto. After that, the recording medium S is discharged onto a discharge unit 75 by a discharge roller 72. The fixing unit 74 is disposed at an upper portion of the apparatus main body 100A.

First to fourth toner cartridges 9 are each arranged side by side in the horizontal direction below the process cartridges 70 in the order corresponding to the colors of the toner contained in the respective process cartridges 70. More specifically, the first toner cartridge 9Y contains yellow (Y) toner. Similarly, the second toner cartridge 9M contains magenta (M) toner and the third toner cartridge 9C contains cyan (C) toner. The fourth toner cartridge 9K contains black (K) toner. Then, each of the toner cartridges 9 replenishes the toner into the process cartridge 70 containing the toner of the same color.

The replenishment operation by the toner cartridge 9 is performed when a remaining amount detection unit (not illustrated) provided in the apparatus main body of the image forming apparatus 100 detects insufficiency of the toner remaining amount in the process cartridge 70. The toner cartridge 9 is detachably mountable in the image forming apparatus 100 via a mounting unit such as a mounting guide (not illustrated) and a positioning member (not illustrated) provided in the image forming apparatus 100. The details of the process cartridge 70 and the toner cartridge 9 will be described below.

First to fourth toner conveyance devices 18 are arranged below the toner cartridges 9 in correspondence with the respective toner cartridges 9. Each of the toner conveyance devices 18 conveys upward the toner received from each of the toner cartridges 9 to supply it to each of development units 4.

<Process Cartridge>

Figure 2:
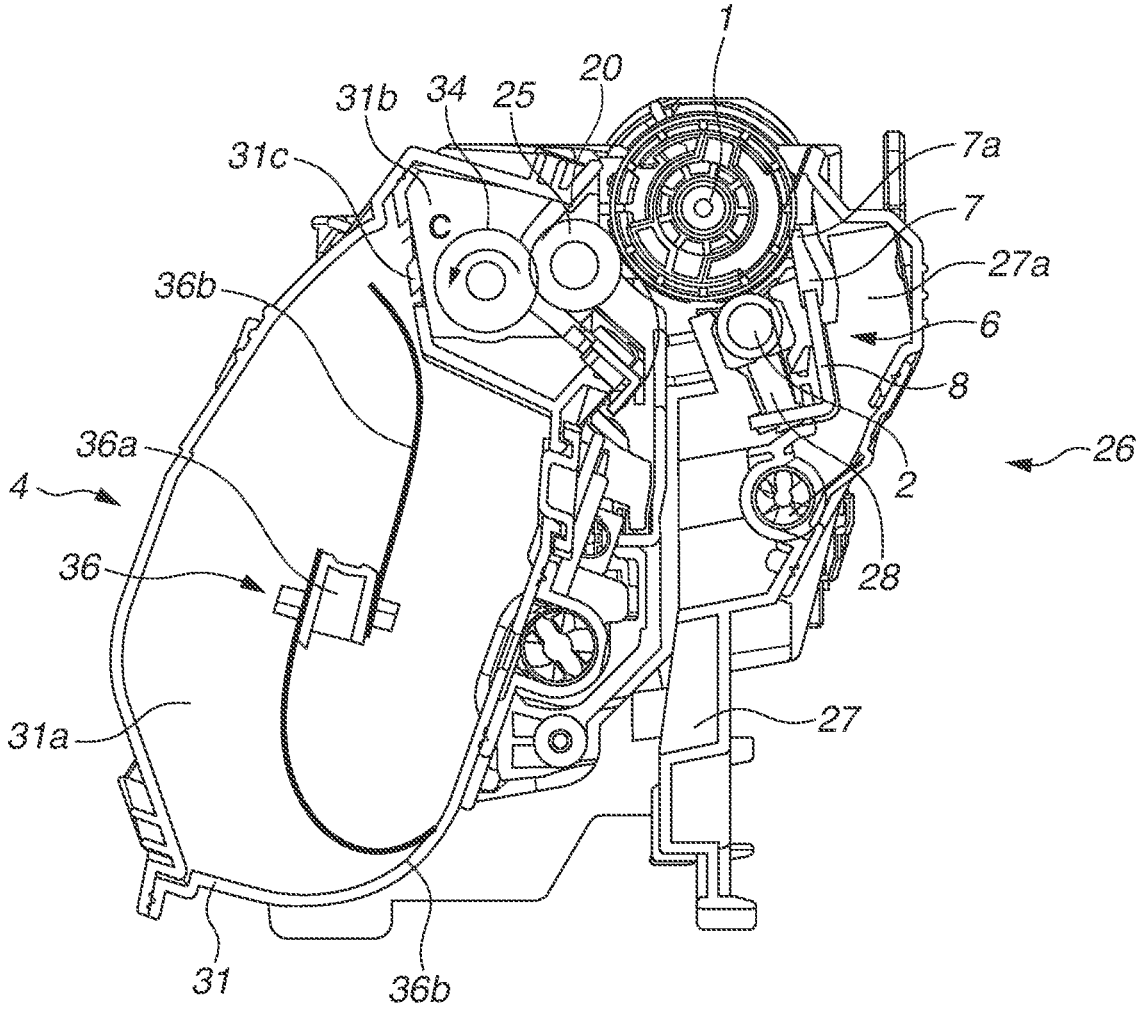
FIG. 2 is a diagram illustrating the process cartridge according to the embodiment.

The process cartridge 70 (a development cartridge) according to the present embodiment will be described with reference to FIG. 2. FIG. 2 is a main cross-sectional view of the process cartridge 70 containing the toner. The cartridge 70Y containing the yellow toner, the cartridge 70M containing the magenta toner, the cartridge 70C containing the cyan toner, and the cartridge 70K containing the black toner are configured similarly to one another.

The process cartridge 70 (70Y, 70M, 70C, 70K) includes a cleaning unit 26 (26*a*, 26*b*, 26*c*, 26*d*) and the development unit 4 (4*a*, 4*b*, 4*c*, 4*d*). The cleaning unit 26 includes the photosensitive drum 1 (1*a*, 1*b*, 1*c*, 1*d*), the charging roller 2 (2*a*, 2*b*, 2*c*, 2*d*), and the cleaning member 6 (6*a*, 6*b*, 6*c*, 6*d*). The development unit 4 includes the development roller 25.

The charging roller 2 and the cleaning member 6 are disposed on the circumference of the photosensitive drum 1 as described above. The cleaning member 6 includes an elastic member 7 made of a rubber blade and a cleaning support member 8. A distal end portion 7*a* of the rubber blade 7 is arranged in abutment with the photosensitive drum 1 from a counter direction to the rotational direction of the photosensitive drum 1. The residual toner removed from the surface of the photosensitive drum 1 by the cleaning member 6 drops down into a removed toner chamber 27*a*. Further, a scooping sheet (not illustrated) for preventing a leak of the removed toner in the removed toner chamber 27*a* is in abutment with the photosensitive drum 1. The photosensitive drum 1 is rotationally driven according to the image forming operation by transmitting a driving force of a main body driving motor (not illustrated) serving as a driving source to the cleaning unit 26. The charging roller 2 is rotatably attached to the cleaning unit 26 via a charging roller bearing 28, and is pressed toward the photosensitive drum 1 by a charging roller pressing member (not illustrated) and rotates by being driven by the photosensitive drum 1.

<Development Unit>

Figure 3:
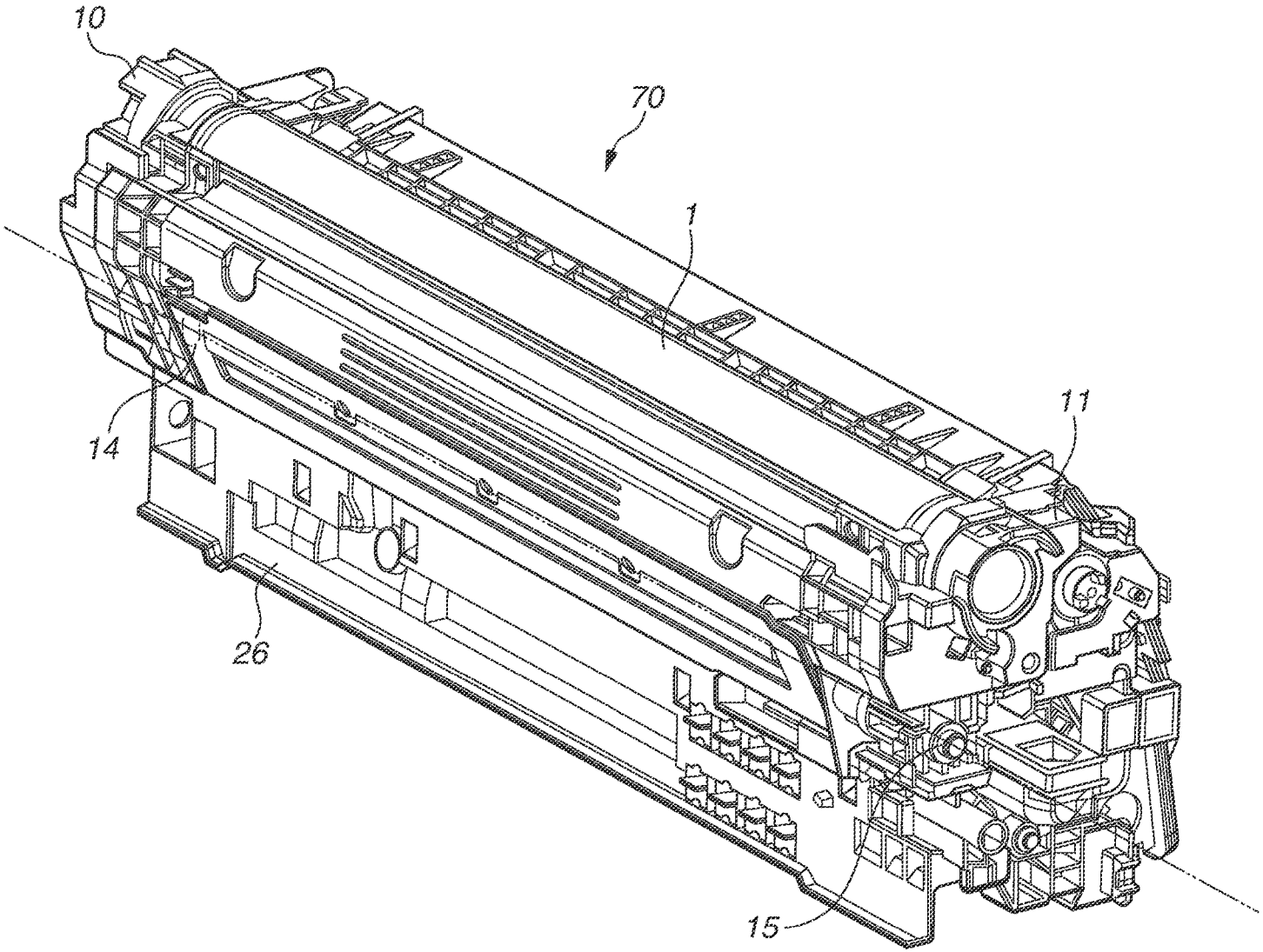
FIG. 3 is a perspective view illustrating the process cartridge according to the embodiment.

As illustrated in FIGS. 2 and 3, the development unit 4 includes the development roller 25, which rotates in contact with the photosensitive drum 1, and a development frame member 31, which supports the development roller 25. The development frame member 31 includes a development chamber 31*b*, in which the development roller 25 is disposed.

Figure 4:
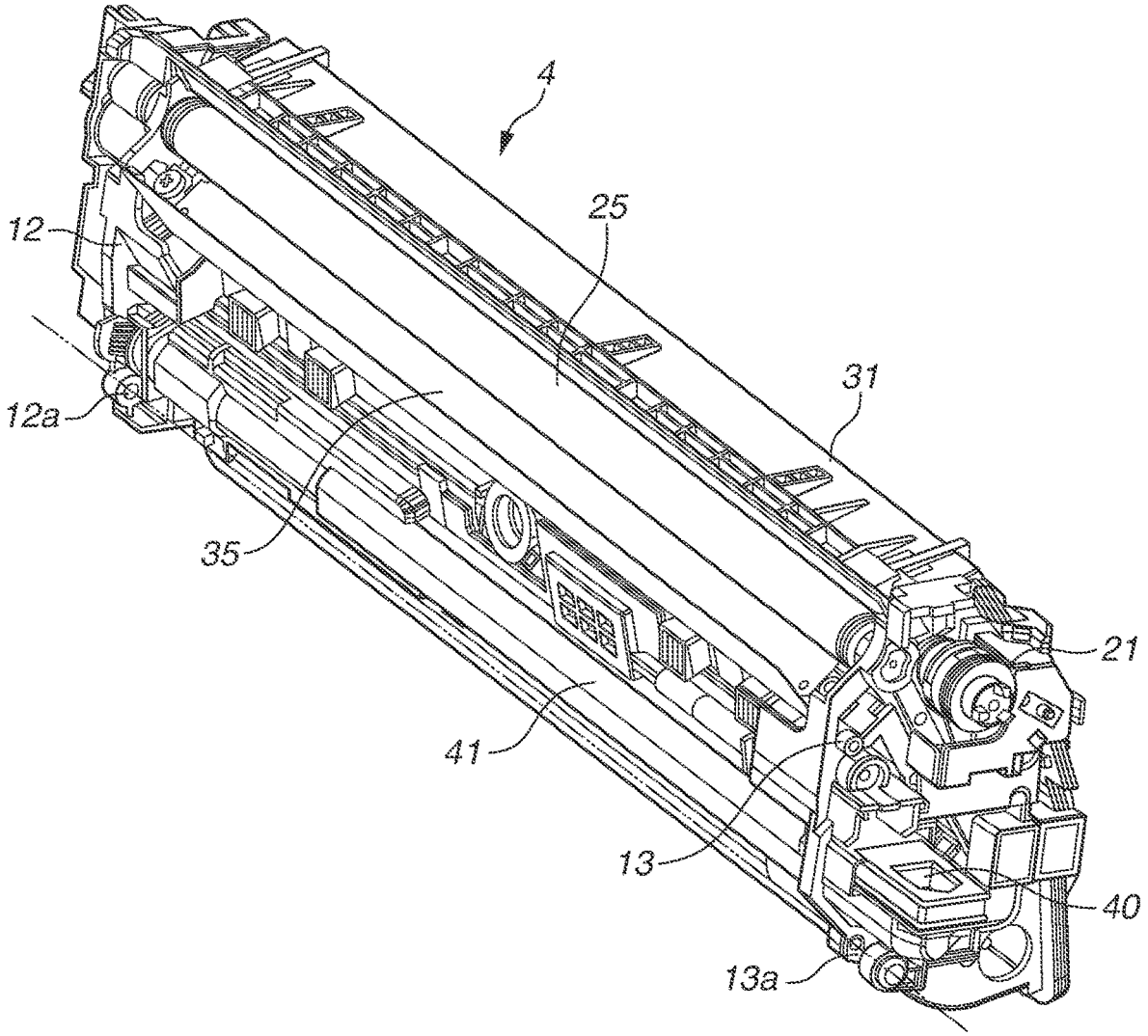
FIG. 4 is a perspective view illustrating a development unit according to the embodiment.

As illustrated in FIG. 4, the development roller 25 is rotatably supported on the development frame member 31 via a development front bearing 12 and a development rear bearing 13 attached on the both sides of the development frame member 31, respectively. Further, a toner supply roller 34, which rotates in a direction indicated by an arrow C in contact with the development roller 25, and a development blade 35, which is used to regulate the toner layer on the development roller 25, are provided in the development chamber 31*b*.

When the toner supplied from the toner supply roller 34 to the development roller 25 passes through the development blade 35, the toner coating amount on the development roller 25 is regulated and the toner is also charged. As a result, a toner coating is created optimally to develop the latent image formed on the photosensitive drum 1.

The development roller 25 and the photosensitive drum 1 each rotate in such a manner that their surfaces move in the same direction as each other (the direction from the bottom to the top in the present embodiment) at a portion where they face each other (a portion where they contact each other). In the present embodiment, in reaction to a predetermined direct-current (DC) bias applied to the development roller 25, the toner negatively charged with the aid of triboelectric charging is transferred only to a bright potential portion due to a potential difference therebetween and visualizes the electrostatic latent image at a development portion in contact with the photosensitive drum 1.

Figure 5:
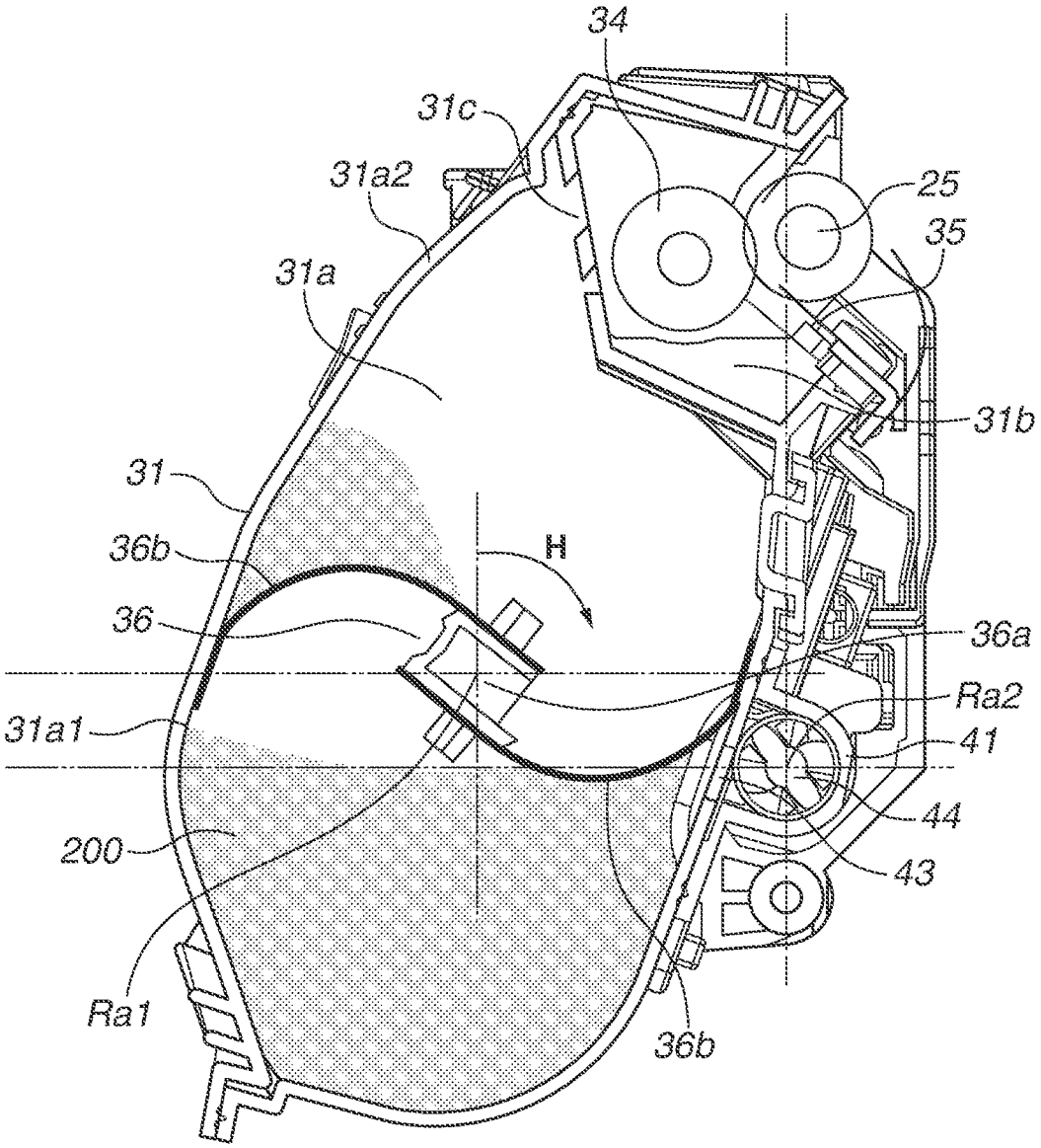
FIG. 5 is a diagram illustrating a toner conveyance operation according to the embodiment.

As illustrated in FIG. 5, the development frame member 31 includes a toner containing chamber 31*a* (a developer containing chamber), which is provided below the development chamber 31*b* and contains the toner, and an opening portion 31*c* (a first opening portion), which establishes communication between the development chamber 31*b* and the toner containing chamber 31*a*. A toner conveyance member 36 (a stirring member), which is used to stir the toner contained in the toner containing chamber 31*a* and also convey the toner to the development chamber 31*b* (the toner supply roller 34), is provided in the toner containing chamber 31*a*.

The toner conveyance member 36 includes a stirring shaft 36*a*, which extends in the direction of the rotational axis of the development roller 25, and a sheet member 36*b* (a sheet), which is fixed to the stirring shaft 36*a* so as to rotate together with the stirring shaft 36*a*. The sheet member 36*b* is configured to be able to be elastically deformed by receiving a force from outside. The sheet member 36*b* is a flexible sheet. The driving force is input to the development unit 4 as a result of engagement of an Oldham coupling 21 (a driving force reception member), which is provided at a longitudinal end portion of the toner supply roller 34 illustrated in FIG. 4, with a main body development coupling (not illustrated) of the apparatus main body 100A. The development unit 4 is configured in such a manner that this driving force is transmitted to a drive train (a driving transmission member) of the development unit 4 and the toner conveyance member 36 rotates thereby.

<Toner Cartridge>

Figure 6A:
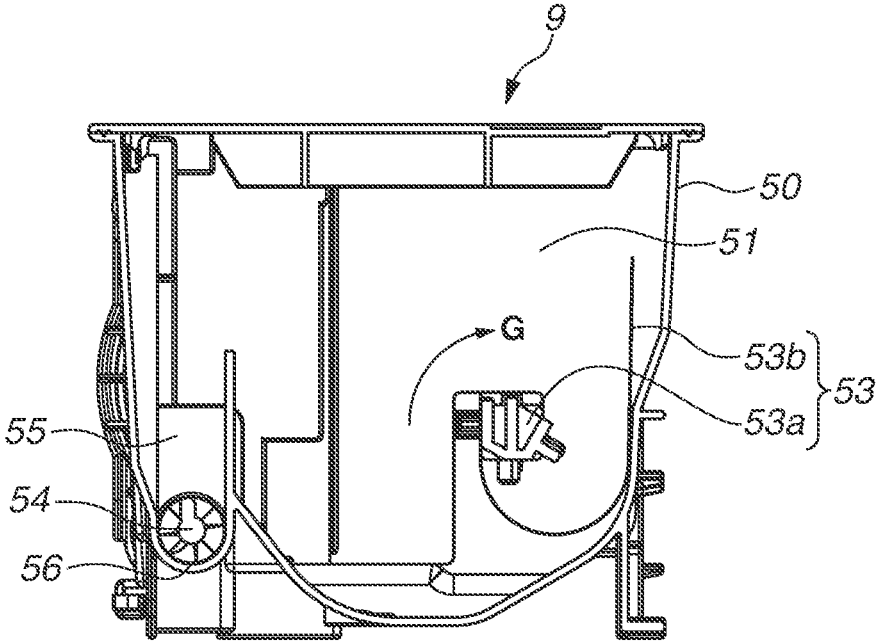
FIG. 6A and 6B are main cross-sectional views of a toner cartridge (Y, M, and C) according to the embodiment.
Figure 6B:
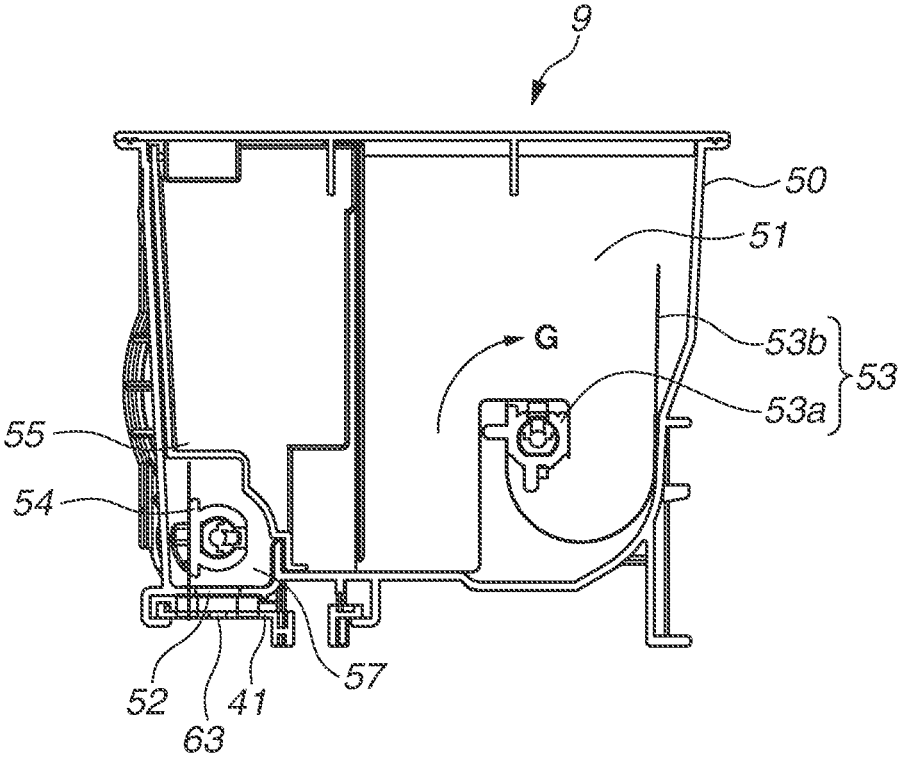
Figure 7A:
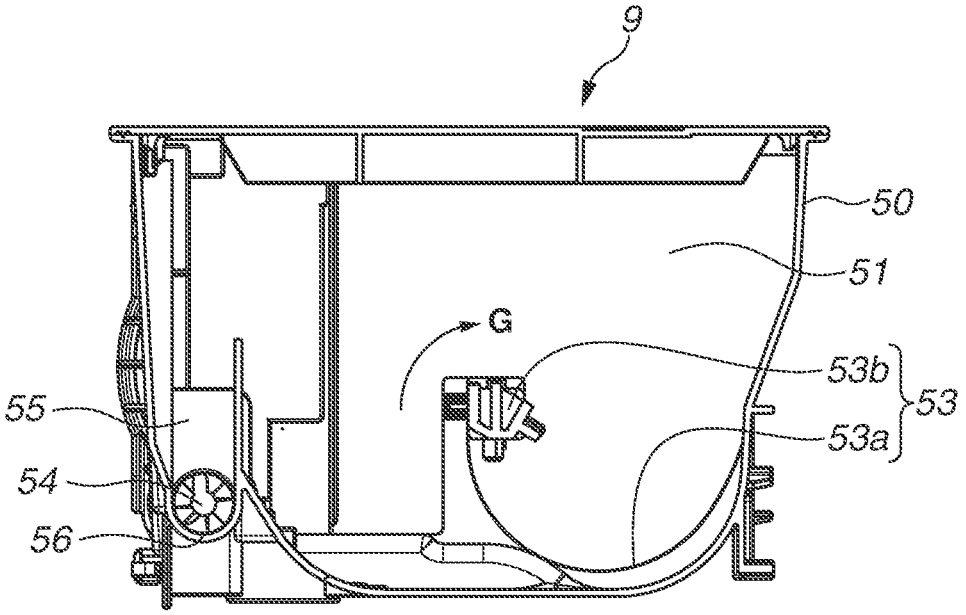
FIGS. 7A and 7B are main cross-sectional views of a toner cartridge (K) according to the embodiment.
Figure 7B:
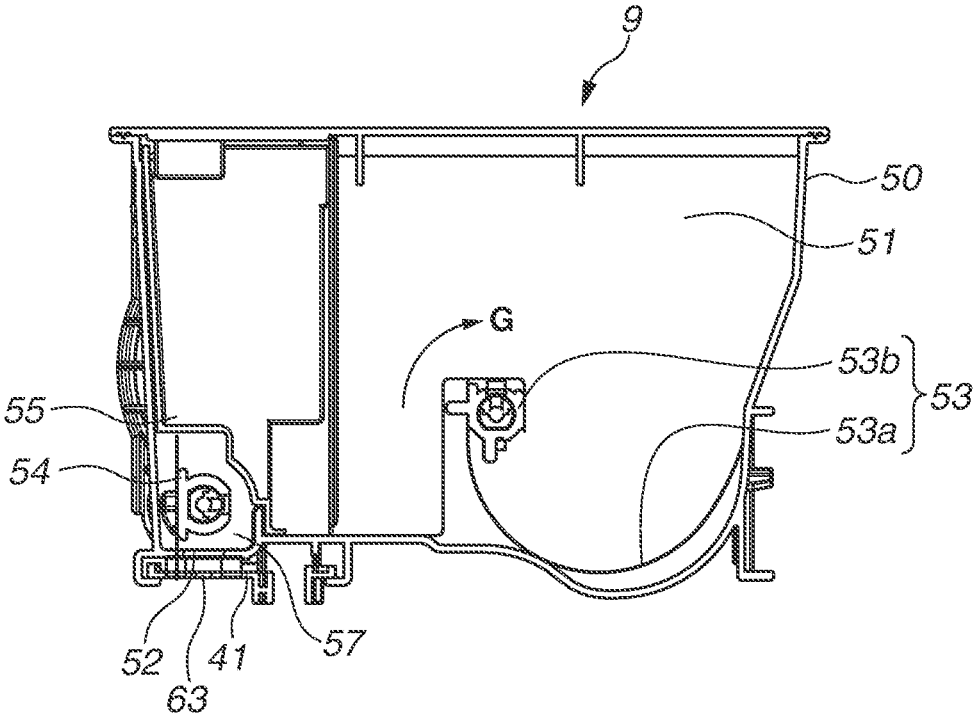
Figure 8A:
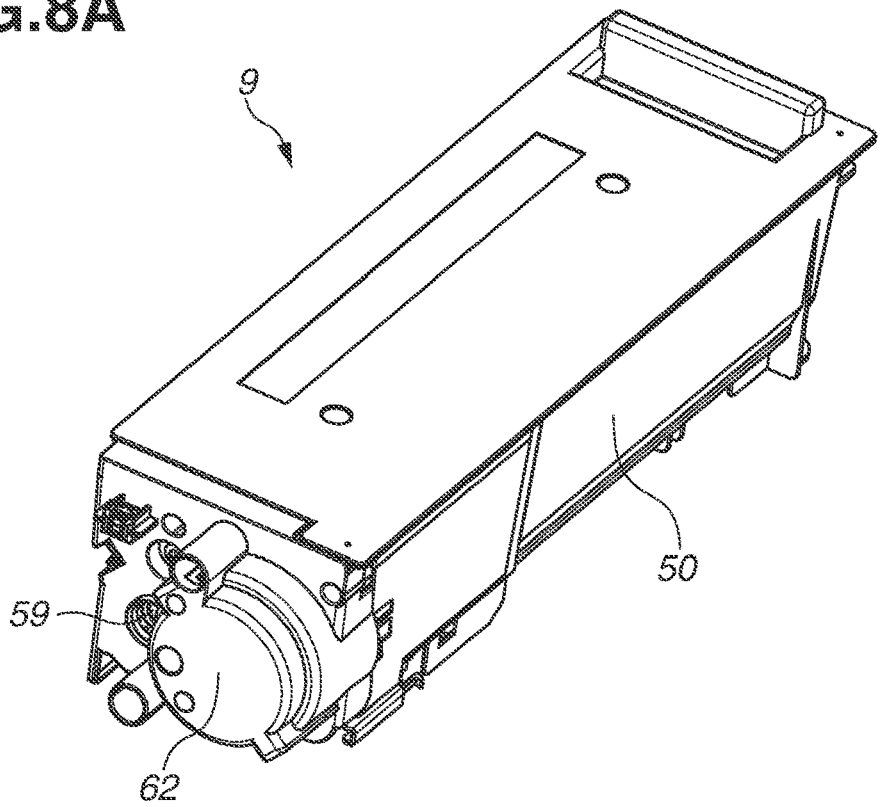
FIGS. 8A and 8B are overall perspective views of the toner cartridge (Y, M, and C) according to the embodiment as viewed from behind.
Figure 8B:
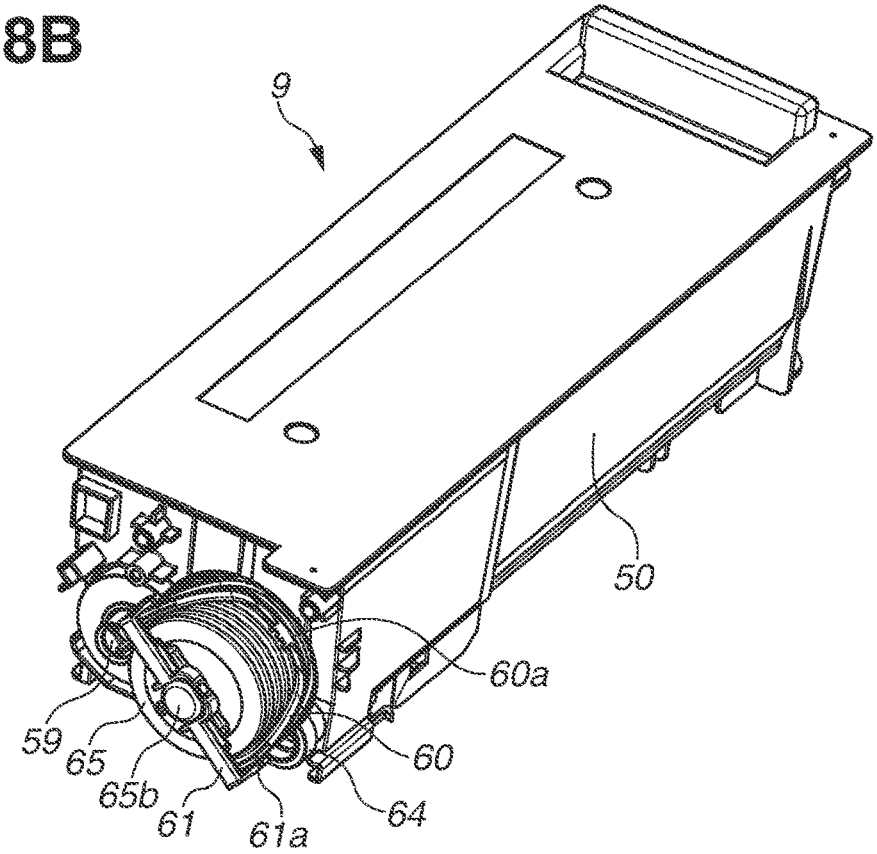

Next, the overall configuration of the toner cartridge 9 mounted in the image forming apparatus 100 according to the present embodiment will be described with reference to FIGS. 6A and 6B. FIG. 6A is a cross-sectional view of the toner cartridge (9Y, 9M, 9C) according to the present embodiment at the central portion in the longitudinal direction (the front-rear direction). FIG. 6B is a cross-sectional view of the toner cartridge (9Y, 9M, 9C) according to the present embodiment at a replenishment frame member opening 52 on the rear side in the longitudinal direction (the front-rear direction). FIG. 7A is a cross-sectional view of the toner cartridge (9K) according to the present embodiment at the central portion in the longitudinal direction (the front-rear direction). FIG. 7B is a cross-sectional view of the toner cartridge (9K) according to the present embodiment at the replenishment frame member opening 52 on the rear side in the longitudinal direction (the front-rear direction). FIG. 8A is a perspective view of the toner cartridge (9Y, 9M, 9C) according to the present embodiment as viewed from behind. FIG. 8B is a perspective view of the toner cartridge (9Y, 9M, 9C) according to the present embodiment with a side cover 62 removed as viewed from behind.

The toner cartridge 9 includes a replenishment frame member 50, which supports various kinds of members in the toner cartridge 9, and a replenishment toner containing chamber 51, which contains the toner therein. Further, the replenishment frame member opening 52 is provided on the lower side in the orientation when the toner cartridge 9 is in normal use (the orientation in use). A replenishment toner stirring member 53, a replenishment toner conveyance screw 54, and a partition member 55 are provided in the replenishment toner containing chamber 51. In the present embodiment, the fourth toner cartridge (9K), which contains the black toner, is configured to be larger in the width direction (the right-left direction) compared to the first to third toner cartridges (9Y, 9M, and 9C), which contain the color toner.

The replenishment toner stirring member 53 is disposed in parallel with the longitudinal direction of the toner cartridge 9, and is rotatably supported on the replenishment frame member 50. Further, the replenishment toner stirring member 53 includes a rotational shaft 53*a* and a replenishment stirring sheet 53*b* as a conveyance member, which is a flexible sheet. One end of the replenishment stirring sheet 53*b* is attached to the rotational shaft 53*a*, and the other end of the replenishment stirring sheet 53*b* is configured as a free end. The rotational shaft 53*a* rotates and the replenishment stirring sheet 53*b* rotates in a direction indicated by an arrow G, by which the toner is stirred by the replenishment stirring sheet 53*b* and is conveyed to the replenishment toner conveyance screw 54.

The replenishment toner conveyance screw 54 is disposed in parallel with the rotational axis of the replenishment toner stirring member 53, and is rotatably supported on the replenishment frame member 50. The replenishment toner conveyance screw 54 conveys the toner in the replenishment toner containing chamber 51 from the front side to the rear side (from the upstream side to the downstream side in the direction in which the toner cartridge 9 is mounted) by rotating. In other words, the replenishment toner conveyance screw 54 conveys the toner toward the replenishment frame member opening 52.

The partition member 55 forms a tunnel portion 56 together with the replenishment frame member 50. The tunnel portion 56 is formed in correspondence with the outer diameter of the replenishment toner conveyance screw 54, and plays a role of conveying a fixed amount by scraping off the toner conveyed by the replenishment toner conveyance screw 54. Further, similarly, the partition member 55 forms a toner discharge chamber 57 together with the replenishment frame member 50.

The replenishment frame member opening 52 is provided at the toner discharge chamber 57. Further, a pump 65, which includes an extensible/compressible bellows portion 65*a*, is provided in communication with the inside. The pump 65 is extended/compressed by a drive train, which will be described below, and can change the inner volume thereof. The extension/compression of the pump 65 causes the inner pressures in the replenishment toner containing chamber 51 and the toner discharge chamber 57 to be changed and air to be supplied and exhausted into and from the replenishment frame member opening 52, thereby allowing the toner to be stably discharged.

The drive train is disposed behind the toner cartridge 9. A driving input gear 59 receives rotational driving from the image forming apparatus 100 and transmits the rotation to a cam gear 60. A cam groove 60*a* is provided on the cam gear 60, and a link protrusion portion 61*a* of a link mechanism 61 is engaged with the cam groove 60*a*. The link mechanism 61 is supported on the side cover 62 movably in the front-rear direction. The rotation of the cam gear 60 causes the cam link portion 61*a* to pass through the ridge portion and the bottom portion of the cam groove 60*a* alternately, thereby causing the link mechanism 61 to reciprocate in the front-rear direction. The link mechanism 61 is coupled with a coupling portion 65*b* of the pump 65, and the coupling portion 65*b* of the pump 65 reciprocates according to the movement of the link mechanism 61. Then, the bellows portion 65*a* of the pump 65 is extended/compressed, which causes a change in the inner volume in the pump 65, thereby causing changes in the inner pressures in the replenishment toner containing chamber 51 and the toner discharge chamber 57 as a result thereof. Next, a screw gear 64 is provided at an end portion of the above-described replenishment toner conveyance screw 54, and the screw gear 64 receives rotational driving from the cam gear 60 and rotates the replenishment toner conveyance screw 54.

Further, at the toner discharge chamber 57 on the bottom surface thereof in the orientation when the toner cartridge 9 is in normal use (the orientation in use), the replenishment frame member opening 52 is provided, and a replenishment port shutter 41 including a replenishment port 63 is supported on the replenishment frame member 50 movably in the front-rear direction. The replenishment frame member opening 52 is closed by the replenishment port shutter 41 when the toner cartridge 9 is not mounted in the image forming apparatus 100. The replenishment port shutter 41 is configured to be biased by the image forming apparatus 100 and moved to a predetermined position in conjunction with the operation for mounting the toner cartridge 9. When the replenishment port shutter 41 is mounted in the image forming apparatus 100, the replenishment frame member opening 52 and the replenishment port 63 are brought into communication with each other, thereby allowing the toner to be discharged from the toner cartridge 9.

<Toner Replenishment Operation>

Next, a toner replenishment operation according to the present embodiment will be described.

As illustrated in FIG. 4, a toner reception port 40 is provided on the development unit 4 at one end (a longitudinal end portion) thereof on the downstream side in the direction in which the process cartridge 70 is mounted, and a reception conveyance path 41 is provided in communication with the toner reception port 40. The toner discharged from the toner cartridge 9 is supplied to the toner reception port 40 by the toner conveyance device 18 installed in the apparatus main body 100A.

As illustrated in FIG. 5, a reception conveyance screw 44 (a conveyance member) is disposed inside the reception conveyance path 41. The reception conveyance path 41 extends in the direction of the rotational axis of the development roller 25 (the longitudinal direction). The reception conveyance screw 44 includes a shaft portion and a helical blade portion provided on the outer periphery of the shaft portion, and is configured to convey the toner by rotating. Further, as illustrated in FIG. 5, a rotational axis (Ra2) of the reception conveyance screw 44 (the conveyance member) is located on the lower side with respect to a rotational axis (Ra1) of the toner conveyance member 36 with the process cartridge 70 mounted in the apparatus main body 100A.

The toner containing chamber 31*a* includes a containing chamber communication port 43 (a second opening portion) for receiving the toner received from the toner reception port 40 and conveyed through in the reception conveyance path 41 by the reception conveyance screw 44 into the toner containing chamber 31*a*. The containing chamber communication port 43 is provided at the longitudinally central portion of the development unit 4 (the toner containing chamber 31*a*), and establishes communication between the reception conveyance path 41 and the toner containing chamber 31*a*. The containing chamber communication port 43 is located on the lower side with respect to the rotational axis (Ra1) of the toner conveyance member 36 with the process cartridge 70 mounted in the apparatus main body 100A. The containing chamber communication port 43 is provided at such a position that the sheet member 36*b* of the toner conveyance member 36 passes through the front side thereof when rotating. The sheet member 36*b* passes through the front side of the containing chamber communication port 43 so as to close the containing chamber communication port 43.

<Toner Conveyance Configuration>

Next, the toner conveyance configuration in the development unit 4 will be described in detail with reference to FIGS. 4 and 5. Directions such as upward, downward, vertical, and horizontal directions regarding the members and the like in the development unit 4 refer to the directions in the orientation of the development unit 4 with the process cartridge 70 mounted in the apparatus main body 100A and the image forming apparatus 100 ready to form an image.

The reception conveyance screw 44 provided in the development unit 4 extends in the direction of the rotational axis of the development roller 25, and conveys the toner received from the toner reception port 40 into the toner containing chamber 31*a* via the containing chamber communication port 43.

The inner wall of the toner containing chamber 31*a* includes a deformation portion 31*a*1 (a first portion) in abutment with the sheet member 36*b* below the opening portion 31*c*. The deformation portion 31*a*1 is provided in a region of the inner wall opposite of a region of the inner wall where the containing chamber communication port 43 of the toner containing chamber 31*a* is provided with respect to the rotational axis Ra1 in cross section perpendicular to the rotational axis Ra1 of the toner conveyance member 36. The sheet member 36*b* of the toner conveyance member 36 is elastically deformed (deflected) by abutting against the deformation portion 31*a*1 and receiving a force from the deformation portion 31*a*1 when the toner conveyance member 36 rotates. Further, the toner conveyance member 36 rotates with the sheet member 36*b* in contact with the deformation portion 31*a*1, thereby rotating with the toner borne on the surface of the sheet member 36*b* on the downstream side in the rotational direction thereof and conveying the toner in the rotational direction of the toner conveyance member 36 while stirring the toner. In the present embodiment, the deformation portion 31*a*1 refers to a portion of the inner wall of the toner containing chamber 31*a* as far as a position at which the sheet member 36*b* separates therefrom, as illustrated in FIG. 5. Further, the inner wall of the toner containing chamber 31*a* includes a restoration portion 31*a*2 (a second portion) on the downstream side of the deformation portion 31*a*1 and the upstream side of the opening portion 31*c* in the rotational direction of the toner conveyance member 36. The restoration portion 31*a*2 is provided in the region of the inner wall opposite of the region of the inner wall where the containing chamber communication port 43 of the toner containing chamber 31*a* is provided with respect to the rotational axis Ra1 in cross section perpendicular to the rotational axis Ra1 of the toner conveyance member 36.

Now, the restoration portion 31*a*2 is a portion for restoring (resolving) at least a part of the elastic deformation (the deflection) due to the contact of the sheet member 36*b* with the inner wall of the toner containing chamber 31*a*. In the present embodiment, the restoration portion 31*a*2 is arranged on the upper side with respect to the horizontal surface passing through the rotational axis (Ra1) of the toner conveyance member 36. Therefore, after the sheet member 36*b* passes through the deformation portion 31*a*1 according to the rotation of the toner conveyance member 36, the contact state of the sheet member 36*b* with the inner wall is resolved at the restoration portion 31*a*2. As a result, the elastic deformation of the sheet member 36*b* caused by the deformation portion 31*a*1 is restored into a natural state with the aid of its own elastic resilient force. The toner borne on the sheet member 36*b* is caused to fly (jumped up) against the gravitational force and is projected toward the opening portion 31*c* according to the geometry change due to this restoration of the sheet member 36*b*. The inner wall of the toner containing chamber 31*a* is shaped so as to contact with and separate from the sheet member 36*b* in this manner The opening portion 31*c* of the inner wall is located on the downstream side of the restoration portion 31*a*2 in the rotational direction of the toner conveyance member 36. The toner flying toward the opening portion 31*c* is partially supplied into the development chamber 31*b*. On the other hand, toner failing to reach the inside of the development chamber 31*b* drops down into the toner containing chamber 31*a* and returns to the bottom portion of the toner containing chamber 31*a*. The toner is stirred and conveyed by repeating this cycle.

In the case where the containing chamber communication port 43 is disposed at the toner containing chamber 31*a* in the configuration that supplies the toner from the toner containing chamber 31*a* to the development chamber 31*b* by utilizing the rotational driving of the toner conveyance member 36, the following possibility arises.

Toner located near the containing chamber communication port 43 is pushed by the sheet member 36*b* if the reception conveyance screw 44 is not kept driven at the timing when the sheet member 36*b* of the toner conveyance member 36 passes through the front side of the containing chamber communication port 43. One possible consequence thereof is that the toner moves (flows backward) in the reception conveyance path 41 in the opposite direction from the direction in which the toner is conveyed by the reception conveyance screw 44. Further, the toner flowing backward to the reception conveyance path 41 may be aggregated due to a pressure being applied to the toner when the sheet member 36*b* passes through the front side of the containing chamber communication port 43 so as to close the containing chamber communication port 43. If the toner is aggregated in the reception conveyance path 41, the toner may clog the inside of the reception conveyance path 41, making it impossible to replenish a predetermined amount to the toner containing chamber 31*a*.

Therefore, the present embodiment is directed to preventing the toner clog in the containing chamber communication port 43.

<Driving Transmission Configuration of Development Unit>

Next, the driving transmission configuration of the development unit 4 according to an example 1 will be described with reference to FIGS. 9 and 10.

The example 1 is configured in such a manner that the driving of the toner conveyance member 36 and the driving of the reception conveyance screw 44 can be controlled independently of each other.

Figure 9:
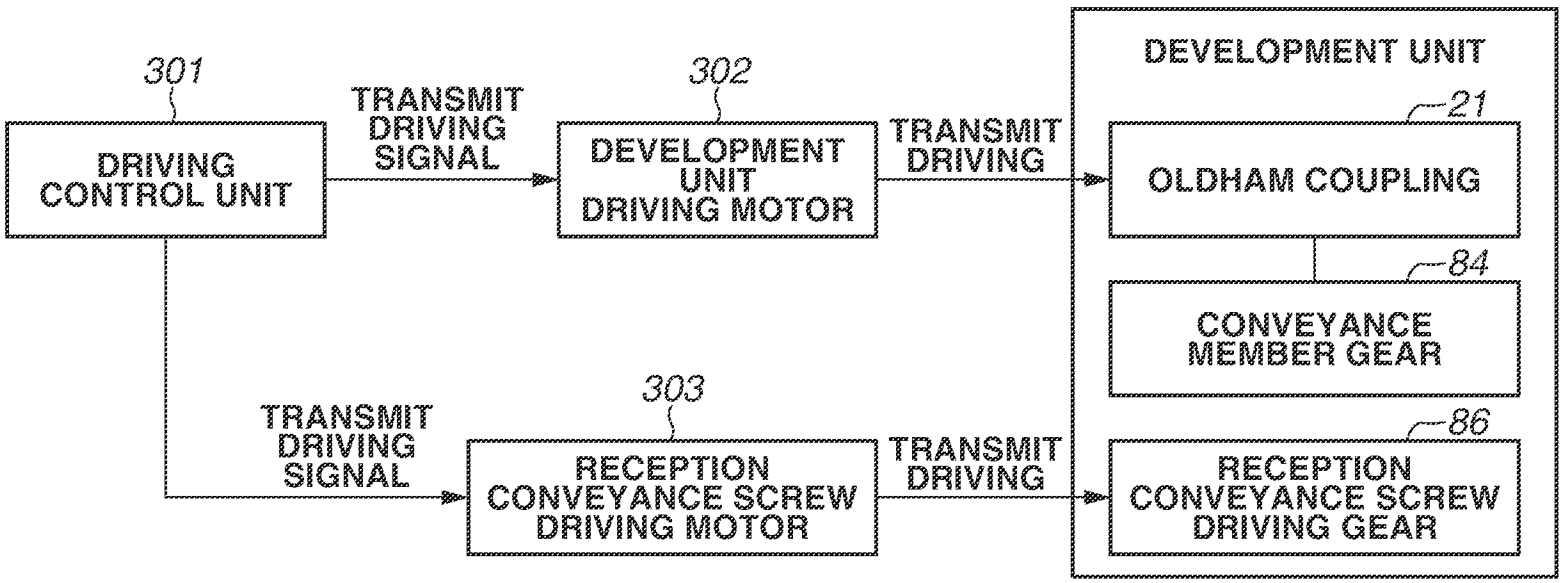
FIG. 9 is a block diagram illustrating a circuit configuration of driving control according to an example 1 of the embodiment.
Figure 10:
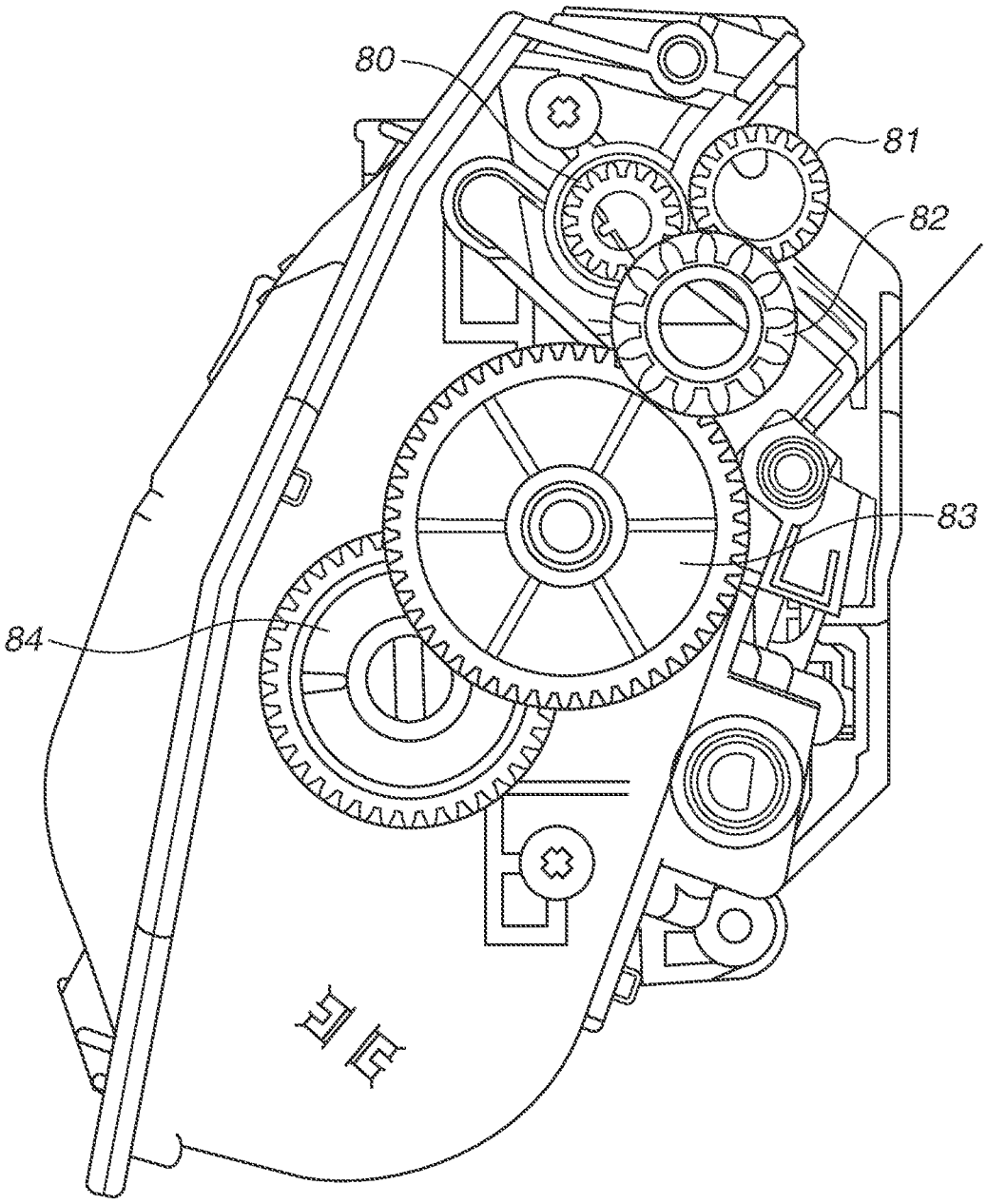
FIG. 10 is a diagram illustrating a drive gear train of the development unit according to the example 1.

FIG. 9 is a block diagram illustrating the circuit configuration of the driving control, which is provided in the image forming apparatus 100 illustrated in, for example, FIG. 1. When the image formation or the replenishment operation is performed, a driving signal is transmitted from a driving control unit 301 illustrated in FIG. 9 to a development unit driving motor 302 (a first driving source) and a reception conveyance screw driving motor 303 (a second driving source), which are driving sources of the apparatus main body 100A.

The driving force output from the development unit driving motor 302 is transmitted to the main body development coupling (not illustrated) of the apparatus main body 100A. Then, the driving force is input from the apparatus main body 100A to the development unit 4 by the engagement of the Oldham coupling 21 (the driving force reception member), which is provided at the longitudinal end portion of the toner supply roller 34, with the main body development coupling (not illustrated). This driving force is transmitted to the gear train provided in the development unit 4, and the driving force is transmitted to a conveyance member gear 84 (a second gear). The conveyance member gear 84 is provided at a longitudinal end portion of the toner conveyance member 36 so as to rotate together with the toner conveyance member 36.

The driving force output from the reception conveyance screw driving motor 303 is transmitted from a reception conveyance screw main body gear (not illustrated) of the apparatus main body 100A to a conveyance screw gear 86 (a third gear). The conveyance screw gear 86 is provided at a longitudinal end portion of the reception conveyance screw 44 so as to rotate together with the reception conveyance screw 44.

Now, the drive gear train provided in the development unit 4 will be described in detail with reference to FIG. 10. As illustrated in FIG. 10, a toner supply roller gear 80 (a first gear) is provided at a second end portion, which is the longitudinal end portion of the toner supply roller 34 opposite from a first end portion at which the Oldham coupling 21 is provided. A development roller gear 81 is provided at the longitudinal shaft portion of the development roller 25 on the same side as the toner supply roller gear 80. The driving force input to the Oldham coupling 21 is transmitted from the toner supply roller gear 80 to the development roller gear 81 via a development idler gear 82, by which the development roller 25 is rotated.

The above-described conveyance member gear 84 is provided at the longitudinal end portion of the toner conveyance member 36 on the same side as the toner supply roller gear 80. A conveyance member idler gear 83 is meshed with both the development idler gear 82 and the conveyance member gear 84, and transmits the driving force from the development idler gear 82 to the conveyance member gear 84. In this manner, the driving force input to the Oldham coupling 21 of the toner supply roller 34 is transmitted to the toner supply roller gear 80, the development idler gear 82, the conveyance member idler gear 83, and the conveyance member gear 84 sequentially in this order.

The gear train such as the toner supply roller gear 80 is provided on the axially opposite side (the other end side) from the driving force input unit of the development unit 4 in light of the space and the like in the present embodiment, but the above-described gear train and the driving force input unit may be provided on the same side.

<Driving Control of Toner Conveyance Member and Reception Conveyance Screw>

The driving control of the toner conveyance member 36 and the reception conveyance screw 44 according to the present example will be described with reference to FIGS. 11A and 11B.

Figure 11A:
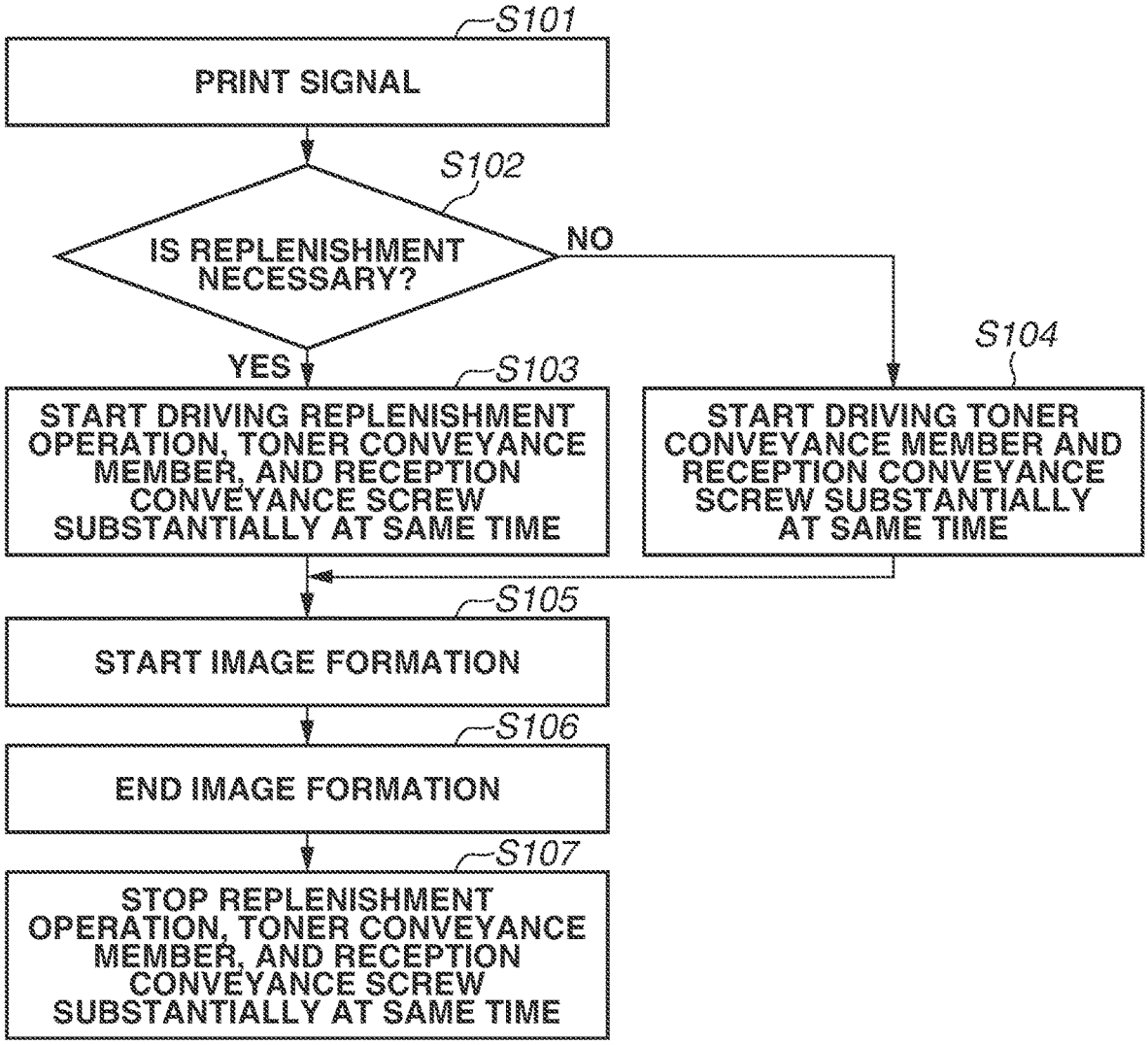
FIGS. 11A and 11B are sequence charts illustrating driving control of a toner conveyance member and a reception conveyance screw according to the example 1.

FIG. 11A is a sequence chart illustrating driving control in a case where the toner conveyance member 36 and the reception conveyance screw 44 are driven substantially at the same time. First, in step S101, a print signal is transmitted to the image forming apparatus 100. Then, in step S102, a replenishment necessity/unnecessity determination device (not illustrated) determines whether the replenishment is necessary. If the replenishment is necessary (YES in step S102), in step S103, the replenishment operation, the toner conveyance member 36, and the reception conveyance screw 44 start being driven substantially at the same time. If the replenishment is unnecessary (NO in step S102), in step S104, the toner conveyance member 36 and the reception conveyance screw 44 start being driven substantially at the same time without the replenishment operation started. In step S105, the image forming operation is started after the driving is started. In step S106, the image forming operation is ended. After that, in step S107, the replenishment operation, the toner conveyance member 36, and the reception conveyance screw 44 are stopped substantially at the same time.

Figure 11B:
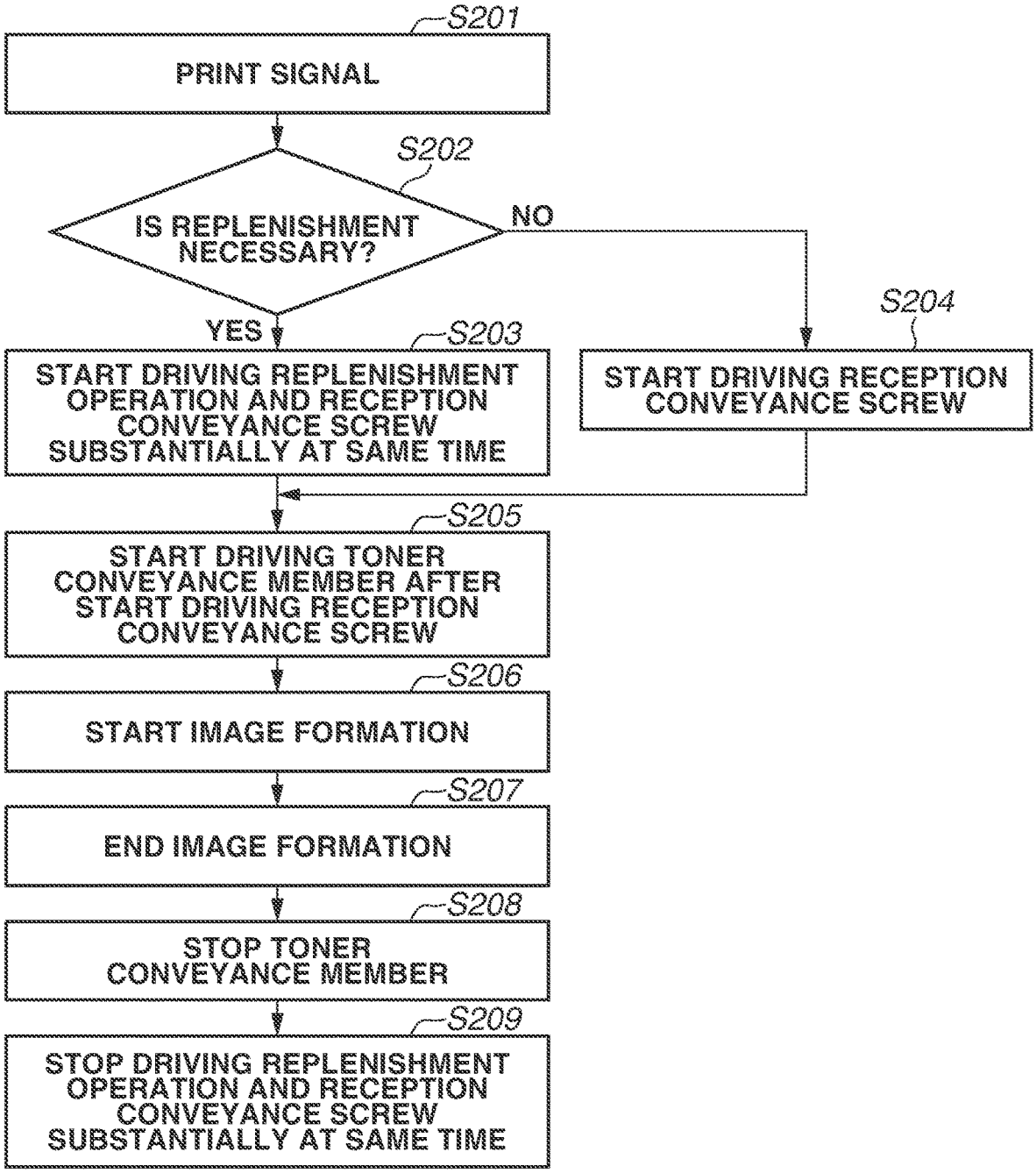

FIG. 11B is a sequence chart illustrating driving control in a case where the toner conveyance member 36 and the reception conveyance screw 44 are driven at different timings. First, in step S201, the print signal is transmitted to the image forming apparatus 100. Then, in step S202, the replenishment necessity/unnecessity determination device (not illustrated) determines whether the replenishment is necessary. If the replenishment is necessary (YES in step S202), in step S203, the replenishment operation and the reception conveyance screw 44 start being driven substantially at the same time. If the replenishment is unnecessary (NO in step S202), in step S204, the reception conveyance screw 44 starts being driven without the replenishment operation started. After the reception conveyance screw 44 starts being driven, in step S205, the toner conveyance member 36 starts being driven. In step S206, the image forming operation is started at the same time as the start of the driving of the toner conveyance member 36. In step S207, the image forming operation is ended. After that, in step S208, the toner conveyance member 36 is stopped. After the operation of the toner conveyance member 36 is stopped, in step S209, the replenishment operation and the reception conveyance screw 44 are stopped at the same time.

In this manner, the reception conveyance screw 44 is kept in a driven state when the toner conveyance member 36 is driven. More specifically, the image forming apparatus 100 can prevent the toner clog in the containing chamber communication port 43 that otherwise might occur due to the backward flow of the toner into the reception conveyance path 41, by keeping the reception conveyance screw 44 in the driven state at the timing when the sheet member 36*b* of the toner conveyance member 36 passes through the front side of the containing chamber communication port 43. Further, the image forming apparatus 100 can prevent occurrence of a failure in the toner supply from the toner cartridge 9.

The reception conveyance screw 44 does not have to be kept driven at timings other than the timing when the sheet member 36*b* of the toner conveyance member 36 passes through the front side of the containing chamber communication port 43. That is, the intended advantageous effects can be achieved as long as the reception conveyance screw 44 is in the driven state at the timing when the sheet member 36*b* of the toner conveyance member 36 passes through the front side of the containing chamber communication port 43.

<Experiment for Evaluating Present Example>

The following experiment was conducted to verify the advantageous effects of the present example. A two-sheet intermittent printing endurance test was conducted under an environment of normal-temperature and normal-humidity conditions (the temperature was 23° C. and the humidity was 60%). In this printing endurance, horizontal lines at an image ratio of 1% were printed. The present experiment started with toner of 200 g loaded in the process cartridge 70, and control was performed such that toner of 10 g is replenished from the toner cartridge 9 every time the toner is reduced by 10 g. Then, the printing endurance continued until the consumed amount of the process cartridge 70 reached 100%, and an evaluation was made regarding whether the toner clog had occurred in the reception conveyance path 41 and the replenishment failure had occurred.

The following three types of driving control were performed as comparison examples. In a comparison example 1, when the print signal was transmitted, the toner conveyance member 36 was driven, and the reception conveyance screw 44 was driven after that. The reception conveyance screw 44 was stopped, and the toner conveyance member 36 was stopped after that. In a comparison example 2, when the print signal was transmitted, the toner conveyance member 36 was driven, and the reception conveyance screw 44 was driven after that. The toner conveyance member 36 was stopped, and the reception conveyance screw 44 was stopped after that. In a comparison example 3, when the print signal was transmitted, the reception conveyance screw 44 was driven, and the toner conveyance member 36 was driven after that. The reception conveyance screw 44 was stopped, and the toner conveyance member 36 was stopped after that.

(Evaluation of Toner Clog)

After the above-described two-sheet intermittent printing endurance test, a pass or a fail was determined based on whether the toner clog had occurred in the reception conveyance path 41. If the toner clog had not occurred, the result was evaluated as a pass.

Figure 12:
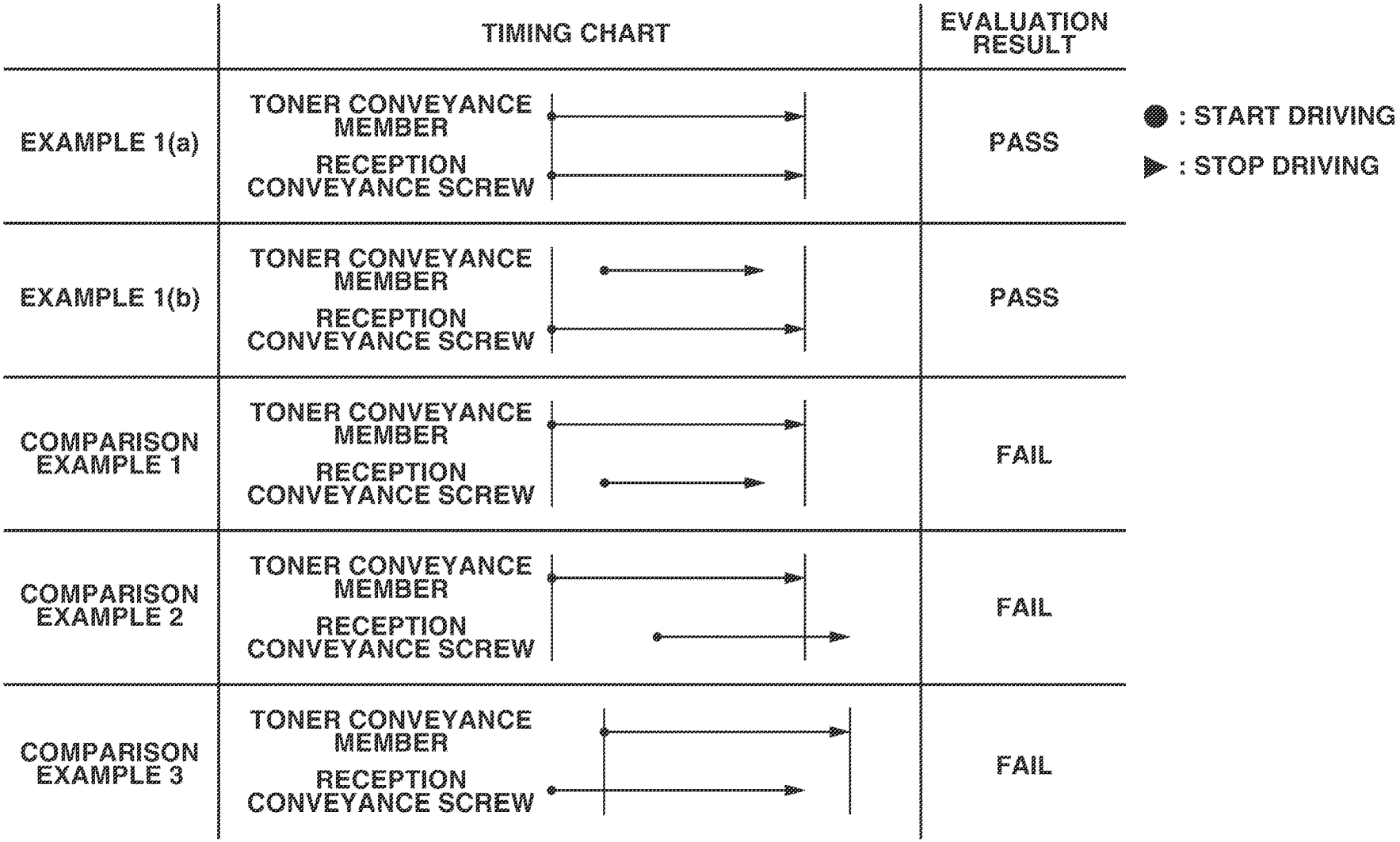
FIG. 12 is a chart illustrating the respective timing charts and evaluation results of a toner clog for examples according to the example 1 and comparison examples.

FIG. 12 illustrates the respective timing charts and evaluation results of the present example and the comparison examples 1, 2, and 3.

The control according to the present example was able to prevent the toner from flowing backward into the reception conveyance path 41 and being aggregated in the reception conveyance path 41 by keeping the reception conveyance screw 44 in a rotating state when the toner conveyance member 36 was rotating. As a result, the toner clog was able to be prevented.

In the control according to the comparison example 1, the reception conveyance screw 44 was driven after the toner conveyance member 36 was driven. Further, the toner conveyance member 36 was stopped after the reception conveyance screw 44 was stopped. Therefore, the toner flowed backward into the reception conveyance path 41 and was aggregated in the reception conveyance path 41. As a result, the toner clog had occurred.

In the control according to the comparison example 2, the reception conveyance screw 44 was driven after the toner conveyance member 36 was driven, and therefore the toner flowed backward into the reception conveyance path 41 and was aggregated in the reception conveyance path 41. As a result, the toner clog had occurred.

In the control according to the comparison example 3, the toner conveyance member 36 was stopped after the reception conveyance screw 44 was stopped, and therefore the toner flowed backward into the reception conveyance path 41 and was aggregated in the reception conveyance path 41. As a result, the toner clog had occurred.

According to the above-described evaluation result, in the present example, the reception conveyance screw 44 is in the driven state at the timing when the sheet member 36*b* of the toner conveyance member 36 passes through the front side of the containing chamber communication port 43. As a result, the present example can prevent the toner clog in the containing chamber communication port 43 that otherwise might occur due to the backward flow of the toner into the reception conveyance path 41. Further, the present example can prevent the occurrence of the failure in the toner supply from the toner cartridge 9.

The image forming apparatus 100 is configured to include two motors, i.e., the motor for driving the reception conveyance screw 44 and the motor for driving the toner conveyance member 36 in the present example, but is not limited thereto. A modification using a single development unit driving motor 302 and an actuator 222 will be described.

Figure 15:
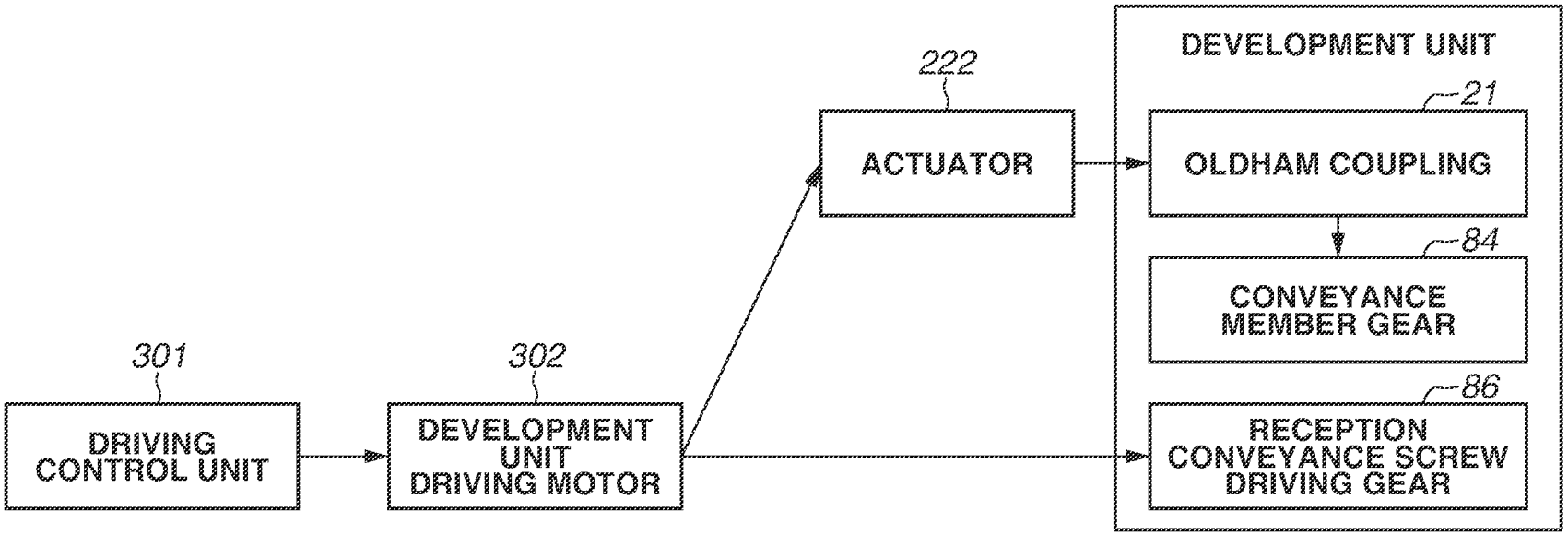
FIG. 15 is a block diagram illustrating driving control according to a modification of the example 1.

FIG. 15 illustrates a block diagram of a driving transmission route according to the modification. The present modification is configured in such a manner that the conveyance screw gear 86 is always driven when the development unit driving motor 302 is driven, and is configured in such a manner that the driving is transmitted from the development unit driving motor 302 to the Oldham coupling 21 via the actuator 222. The actuator 222 is made of an electromagnetic clutch or a spring clutch. The actuator 222 can be switched to a first state, in which the driving force can be transmitted from the development unit driving motor 302 to the Oldham coupling 21, and a second state, in which the transmission of the driving force from the development unit driving motor 302 to the Oldham coupling 21 is blocked. In the second state, the conveyance member gear 84 is not driven and therefore the rotation of the toner conveyance member 36 is stopped. The driving control unit 301 can carry out a first mode of driving the reception conveyance screw 44 while rotating the conveyance member 36 by switching the actuator 222 into the first state, and a second mode of driving the reception conveyance screw 44 with the actuator 222 switched in the second state. In both the first mode and the second mode, the toner aggregation and the toner clog in the reception conveyance path 41 are less likely to occur.

An example 2 is different from the example 1 in that the example 2 includes only a single driving input unit for driving the toner conveyance member 36 and the reception conveyance screw 44.

<Driving Transmission Configuration of Development Unit>

The driving transmission configuration of the development unit 4 will be described with reference to FIGS. 13 and 14.

Figure 13:
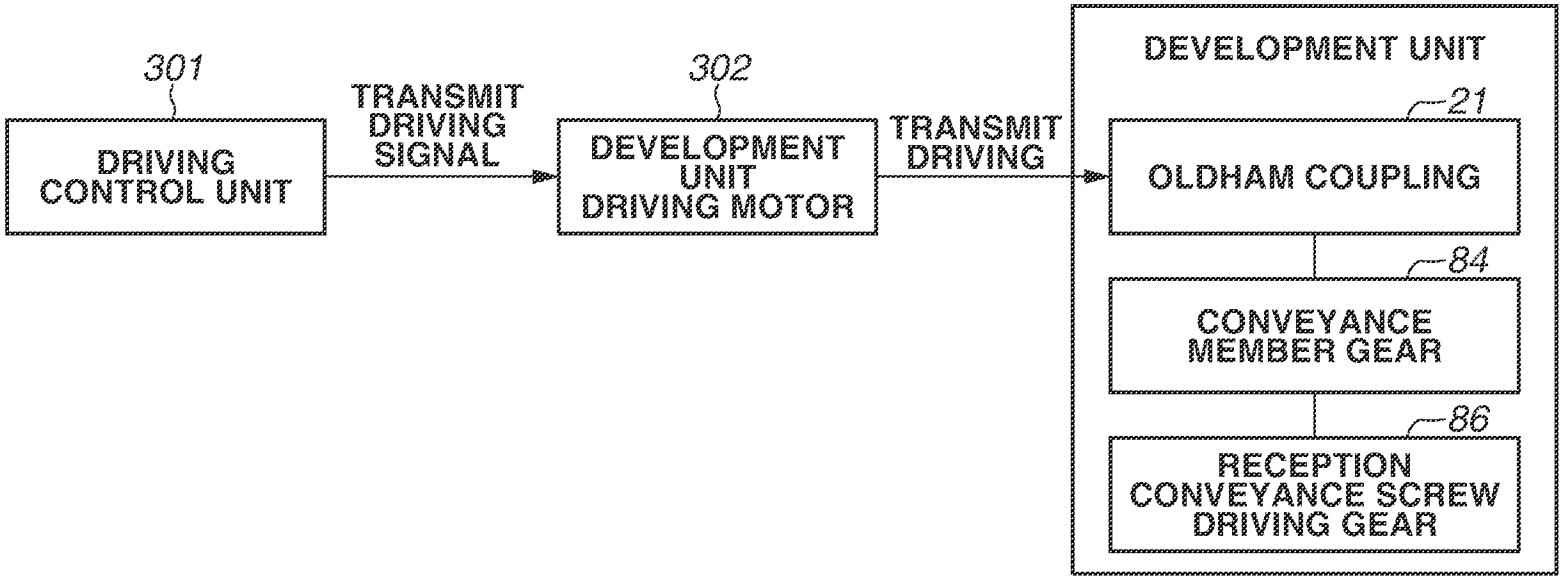
FIG. 13 is a block diagram illustrating the circuit configuration of driving control according to an example 2 of the embodiment.
Figure 14:
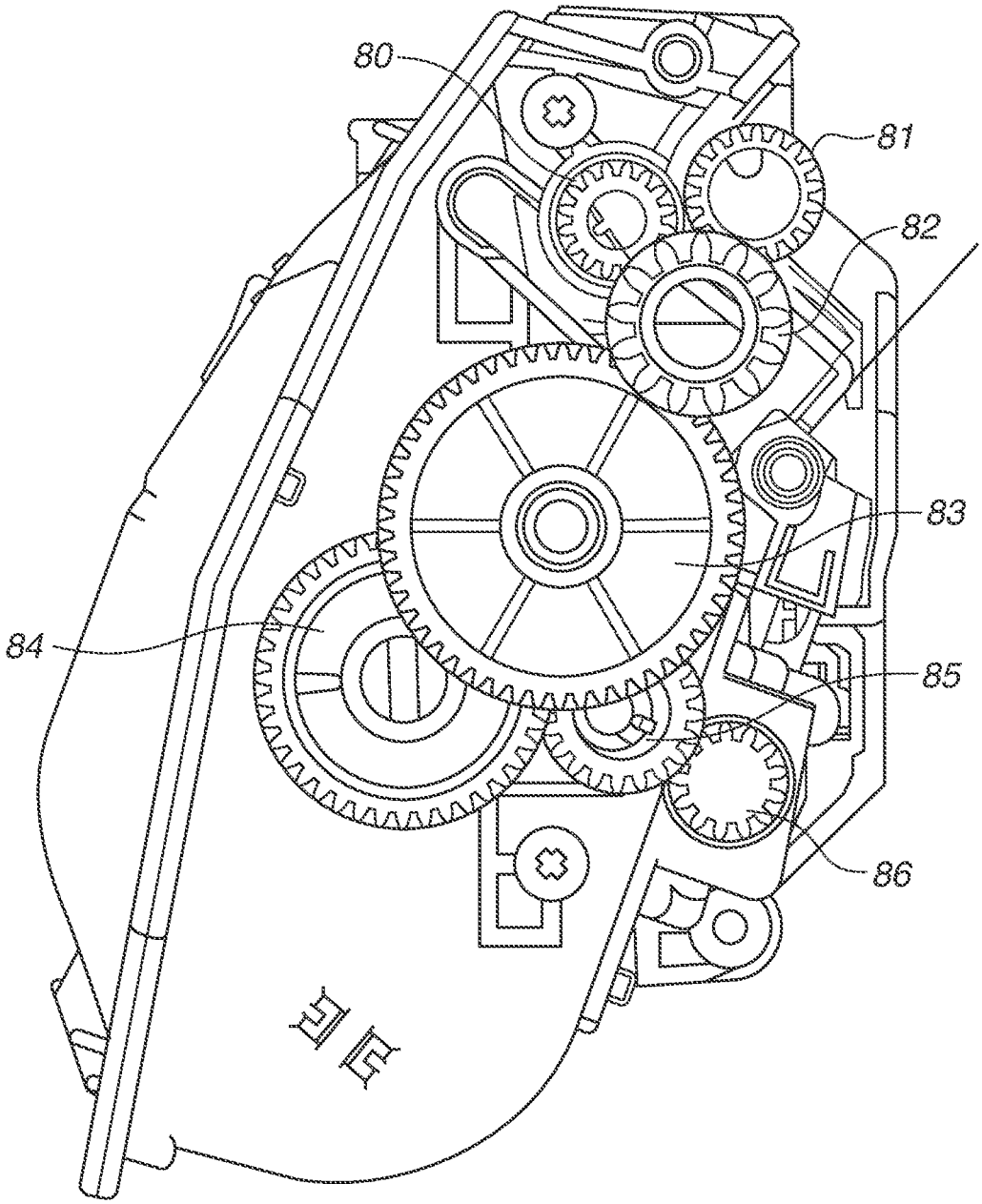
FIG. 14 is a diagram illustrating a drive gear train of a development unit according to the example 2.

FIG. 13 is a block diagram illustrating the circuit configuration of driving control, which is provided in the image forming apparatus 100 illustrated in, for example, FIG. 1. When the image formation or the replenishment operation is performed, the driving signal is transmitted from the driving control unit 301 illustrated in FIG. 13 to the development unit driving motor 302, which is the driving source of the apparatus main body 100A. The Oldham coupling 21 (the driving force reception member) provided at the first end portion, which is the longitudinal end portion of the toner supply roller 34, is engaged with the main body development coupling (not illustrated) of the apparatus main body 100A. Due to this configuration, the driving force output from the development unit driving motor 302 is input to the development unit 4. The Oldham coupling 21 is configured to receive the driving force for driving the development unit 4 from the apparatus main body 100A.

Now, the driving configuration of the development unit 4 will be described in detail with reference to FIG. 14. The toner supply roller gear 80 (the first gear) is provided at the second end portion of the toner supply roller 34 longitudinally opposite from the first end portion. The development roller gear 81 is provided at the longitudinal end portion of the development roller 25 on the same side as the second end portion of the toner supply roller 34. The development idler gear 82, which is meshed with both the toner supply roller gear 80 and the development roller gear 81, is provided. The driving force input from the Oldham coupling 21 at the first end portion of the toner supply roller 34 is transmitted to the development roller gear 81 via the toner supply roller gear 80 and the development idler gear 82, and the development roller 25 is rotationally driven thereby.

The development unit 4 further includes the conveyance member gear 84 (the second gear), the conveyance screw gear 86 (the third gear), the conveyance member idler gear 83 (an intermediate gear), and a reception conveyance screw idler gear 85.

The conveyance member gear 84 is fixed to the longitudinal end portion of the toner conveyance member 36 on the same side as the toner supply roller gear 80, and rotates together with the toner conveyance member 36. The conveyance screw gear 86 is fixed to the longitudinal end portion of the reception conveyance screw 44 on the same side as the toner supply roller gear 80, and rotates together with the reception conveyance screw 44. The conveyance member idler gear 83 is meshed with both the development idler gear 82 and the conveyance member gear 84, and transmits the driving force from the development idler gear 82 to the conveyance member gear 84. The reception conveyance screw idler gear 85 is meshed with both the conveyance member idler gear 83 and the conveyance screw gear 86, and transmits the driving force from the reception conveyance member idler gear 83 to the conveyance screw gear 86.

The driving force input to the Oldham coupling 21 of the toner supply roller 34 is transmitted to the toner supply roller gear 80, the development idler gear 82, the conveyance member idler gear 83, and the conveyance member gear 84 sequentially in this order, and the toner conveyance member 36 is rotationally driven. Further, the driving force transmitted to the conveyance member idler gear 83 is transmitted to the conveyance screw gear 86 via the reception conveyance screw idler gear 85, and the reception conveyance screw 44 is rotationally driven thereby.

As the configuration of the process cartridge 70, the process cartridge 70 includes the Oldham coupling 21, which receives the driving force from the apparatus main body 100A, and the driving force transmission unit configured to transmit the driving force from the Oldham coupling 21 to the toner conveyance member 36 and the reception conveyance screw 44. The driving force transmission unit includes all the above-described gears for rotationally driving the toner conveyance member 36 and the reception conveyance screw 44. This driving force transmission unit is configured in such a manner that, when the Oldham coupling 21 is rotated, the toner conveyance member 36 and the reception conveyance screw 44 are always rotated (always driven).

<Operation Timings of Toner Conveyance Member and Reception Conveyance Screw>

The operation timings of the toner conveyance member 36 and the reception conveyance screw 44 according to the present example will be described with reference to FIGS. 11A and 11B.

The operation timings of the toner conveyance member 36 and the reception conveyance screw 44 according to the present example are controlled in a similar manner to the control described with reference to FIG. 11A. The toner conveyance member 36 and the reception conveyance screw 44 start being driven substantially at the same time, and stop being driven substantially at the same time. The reception conveyance screw 44 is always kept in the rotating state while the toner conveyance member 36 is rotating. More specifically, the toner clog in the containing chamber communication port 43 that otherwise might occur due to the backward flow of the toner into the reception conveyance path 41 can be prevented, by keeping the reception conveyance screw 44 in the driven state at the timing when the sheet member 36*b* of the toner conveyance member 36 passes through the front side of the containing chamber communication port 43. Further, the image forming apparatus 100 can prevent the occurrence of the failure in the toner supply from the toner cartridge 9.

<Experiment for Evaluating Present Example>

The following experiment was conducted to verify the advantageous effects of the present example, similarly to the example 1. A two-sheet intermittent printing endurance test was conducted under an environment of normal-temperature and normal-humidity conditions (the temperature was 23° C. and the humidity was 60%). In this printing endurance, horizontal lines at an image ratio of 1% were printed. The present experiment started with toner of 200 g loaded in the process cartridge 70, and control was performed such that toner of 10 g is replenished from the toner cartridge 9 every time the toner is reduced by 10 g. Then, the printing endurance continued until the consumed amount of the process cartridge 70 reached 100%, and an evaluation was made regarding whether the toner clog had occurred in the reception conveyance path 41 and the replenishment failure had occurred.

(Evaluation of Toner Clog)

After the above-described two-sheet intermittent printing endurance test, a pass or a fail was determined based on whether the toner clog had occurred in the reception conveyance path 41. If the toner clog had not occurred, the result was evaluated as a pass.

Similarly to the example 1(a), the toner clog in the containing chamber communication port 43 that otherwise might occur due to the backward flow of the toner into the reception conveyance path 41 can be prevented, by keeping the reception conveyance screw 44 in the rotating state when the toner conveyance member 36 is rotating. Further, the present example can prevent the occurrence of the failure in the toner supply from the toner cartridge 9.

The examples 1 and 2 have been described based on the configuration of the process cartridge including the photosensitive drum and the development unit, but the present invention is also applicable even to a configuration of a development cartridge configured in such a manner that only the development unit 4 is detachably mountable into the apparatus main body of the image forming apparatus. Further, the present invention is also applicable even to a development device fixed to the apparatus main body of the image forming apparatus.

While the present invention has been described with reference to embodiments, it is to be understood that the invention is not limited to the disclosed embodiments. The scope of the following claims is to be accorded the broadest interpretation so as to encompass all such modifications and equivalent structures and functions.

What is claimed is:

1. A cartridge comprising:

a development roller configured to bear a developer on the development roller;

a frame member including a developer containing chamber containing the developer, wherein the developer containing chamber includes an inner wall which constitutes the developer containing chamber and is provided with an inlet port through which the developer is replenished from an outside of the cartridge into the developer containing chamber;

a stirring member configured to rotate about a rotational axis of the stirring member and configured to stir the developer contained in the developer containing chamber, wherein the stirring member includes a stirring shaft and a sheet attached to the stirring shaft so as to rotate together with the stirring shaft, and wherein the sheet of the stirring member is configured to rotate in contact with the inner wall of the developer containing chamber so as to block the inlet port at a predetermined timing; and a conveyance member which is provided outside of the developer containing chamber and which is configured to rotate so as to convey the developer into the developer containing chamber through the inlet port, wherein the conveyance member is configured to rotate at the predetermined timing.

2. The cartridge according to claim 1, further comprising:

a driving force reception member configured to receive a driving force from the outside of the cartridge; and a driving force transmission unit configured to transmit the driving force from the driving force reception member to both the stirring member and the conveyance member, wherein the driving force transmission unit is configured in such a manner that both the stirring member and the conveyance member are being rotated by the driving force while the driving force reception member receives the driving force.

3. The cartridge according to claim 2, further comprising a supply roller configured to supply the developer to the development roller, wherein the driving force reception member is provided at a first end portion which is a longitudinal end portion of the supply roller, wherein the driving force transmission unit includes:

a first gear provided at a second end portion which is a longitudinal end portion of the supply roller opposite to the first end portion, a second gear provided at a longitudinal end portion of the stirring member on the same side as the first gear, a third gear provided at a longitudinal end portion of the conveyance member on the same side as the first gear, and an intermediate gear configured to transmit driving force from the first gear toward the second gear, and wherein the intermediate gear is configured in such a manner that the driving force from the first gear is transmitted from the intermediate gear to the third gear.

4. The cartridge according to claim 1, wherein the cartridge is configured to be attached to an apparatus main body of an image forming apparatus, and wherein the inlet port is located on a lower side with respect to the rotational axis of the stirring member when the cartridge is in a posture in which the cartridge is attached to the apparatus main body.

5. The cartridge according to claim 1, wherein the inlet port is provided at a central portion of the developer containing chamber in a direction of the rotational axis of the stirring member.

6. The cartridge according to claim 1, wherein the sheet of the stirring member is a first sheet and the predetermined timing is a first predetermined timing, wherein the stirring member further includes a second sheet attached to the stirring shaft so as to rotate together with the stirring shaft and to extend in a direction opposite to a direction in which the first sheet extends as viewed in a direction of the rotational axis of the stirring member, wherein the second sheet of the stirring member is configured to rotate in contact with the inner wall of the developer containing chamber so as to block the inlet port at a second predetermined timing different from the first predetermined timing, and wherein the conveyance member is configured to rotate at the second predetermined timing.

7. The cartridge according to claim 1, wherein the conveyance member is a screw including a shaft portion extending in a direction of the rotational axis of the stirring member and a helical blade portion provided on an outer periphery of the shaft portion.

8. The cartridge according to claim 7, wherein the cartridge is configured to be attached to an apparatus main body of an image forming apparatus, and wherein a rotational axis of the conveyance member is located on a lower side with respect to the rotational axis of the stirring member when the cartridge is in a posture in which the cartridge is attached to the apparatus main body.

* * * * *